US008316621B2

(12) United States Patent
Safari Kermanshahi et al.

(10) Patent No.: US 8,316,621 B2
(45) Date of Patent: Nov. 27, 2012

(54) COLD FORMED ROOF AND COLUMNS BUILDING STRUCTURE SYSTEM

(76) Inventors: Kamal Safari Kermanshahi, Tehran (IR); Haddad Miladi, Tehran (IR); Abolghasem Rastgoo, Tehran (IR); Kamran Safari Kermanshahi, Tehran (IR); Koroush Safari Kermanshahi, Tehran (IR)

( * ) Notice: Subject to any disclaimer, the term of this patent is extended or adjusted under 35 U.S.C. 154(b) by 0 days.

(21) Appl. No.: 13/035,973

(22) Filed: Feb. 27, 2011

(65) Prior Publication Data

US 2012/0216475 A1 Aug. 30, 2012

(51) Int. Cl.
*E04C 3/00* (2006.01)

(52) U.S. Cl. ..... 52/837; 52/838; 52/842; 52/693; 52/234

(58) Field of Classification Search ..... 52/836–839, 52/843, 848, 693, 696, 634, 289, 236.3, 236.7, 52/234

See application file for complete search history.

(56) References Cited

U.S. PATENT DOCUMENTS

| | | | | |
|---|---|---|---|---|
| 444,579 | A * | 1/1891 | Jackson | 403/314 |
| 1,883,376 | A * | 10/1932 | Hilpert et al. | 52/654.1 |
| RE21,921 | E * | 10/1941 | Greulich | 52/838 |
| 6,131,362 | A * | 10/2000 | Buecker | 52/842 |
| 6,266,938 | B1 * | 7/2001 | Sheu et al. | 52/633 |
| 6,434,893 | B1 * | 8/2002 | Quenzi | 52/126.1 |
| 6,571,527 | B1 * | 6/2003 | Rattini | 52/692 |
| 7,310,920 | B2 * | 12/2007 | Hovey, Jr. | 52/655.1 |
| 2002/0005022 | A1 * | 1/2002 | Matthews | 52/483.1 |
| 2005/0144892 | A1 * | 7/2005 | Strickland et al. | 52/729.1 |
| 2009/0007520 | A1 * | 1/2009 | Navon | 52/837 |

* cited by examiner

*Primary Examiner* — Brian Glessner
*Assistant Examiner* — Brian D Mattei
(74) *Attorney, Agent, or Firm* — Barry Choobin; Choobin & Choobin Consultancy

(57) ABSTRACT

An improved roof structure formed of metal sheet s. The structure comprises a plurality of cold formed columns supported by a concrete foundation, a plurality of cold formed girders supported by the plurality of columns, a plurality of cold formed beams supported by the plurality of girders, a plurality of cold formed open web joists supported by the plurality of beams, and a plurality of polystyrene roof boards supported by the plurality of joists.

20 Claims, 25 Drawing Sheets

COLD FORMED ROOF AND COLUMNS BUILDING STRUCTURE SYSTEM

BACKGROUND

The present invention relates to structural engineering, building structures and more particularly to a cold formed roof structure.

In recent years, the cost of lumber has increased dramatically as the result of limitations placed upon the harvesting of trees so as to preserve the environment. Within the last few years alone, the cost of lumber has more than doubled. This cost increase has had a major impact on the construction industry, especially cost-wise; making new homes have become difficult to build and sell at affordable prices. This, in turn has resulted in the decrease in new housing starts and increased unemployment within the construction industry. In addition to the increased expenses resulting from the high cost of lumber, there are other reasons that make it desirable to identify a viable alternative to wood for significant portions of the support structure in new construction. These reasons are related to the vulnerability of wood to insect damage and decay, and to the weight of the wood. As a result of this, steel structures paved their way into the construction industry.

Better yet are the cold formed structures made of cold formed structural elements wherein, the cold formed structural elements compared to conventional steel structures are much lighter, stronger, stiffer, easier to prefabricate, easier to mass produce, easier to erect or install, and cheaper, especially in transportation and handling.

SUMMARY

The present invention is a cold formed roof structure built of various cold formed structural elements formed. The roof structure comprises a plurality of columns supported by a concrete foundation, a plurality of girders supported by the columns, a plurality of beams supported by the girders, a plurality of joists supported by the beams, and a plurality of polystyrene roof boards supported by the joists.

The columns, girders, and beams comprise tapered I-shape beams defined by a pair of upper and lower flanges interconnected by a web. The upper and lower flanges are of hollow configuration as they are formed by bending metal sheets. The web comprises an elongate metal sheet. In other embodiments, the web comprises hollow elongate member of rectangular cross section.

The joists comprise open web joists, each comprising an upper chord, a wider lower chord, and open web interconnecting the upper and lower chords. The upper and lower chords of the joists are formed by bending, folding metal sheet s. The open web connects the upper and lower chords by means of forging as opposed to the commonplace welding. The metal sheets employed for forming the structural elements (columns, girders, beams, and the upper and lower chords of joists) of the present invention are preferably ST32 and ST57 sheets, and galvanized and black sheet of different thicknesses.

The roof boards, more particularly, are made of light polystyrene primarily. The roof board comprises a plurality of parallel recesses, each for receiving metal pipes thereinto so as to improve the load bearing capacity thereof. The roof boards are placed on two opposing, successive lower chords as they are supported by the joists.

The advantages of the embodiments herein will become readily apparent from the following detailed description taken in conjunction with the accompanying drawings.

FIGURES

Reference Numerals

Figure 1:
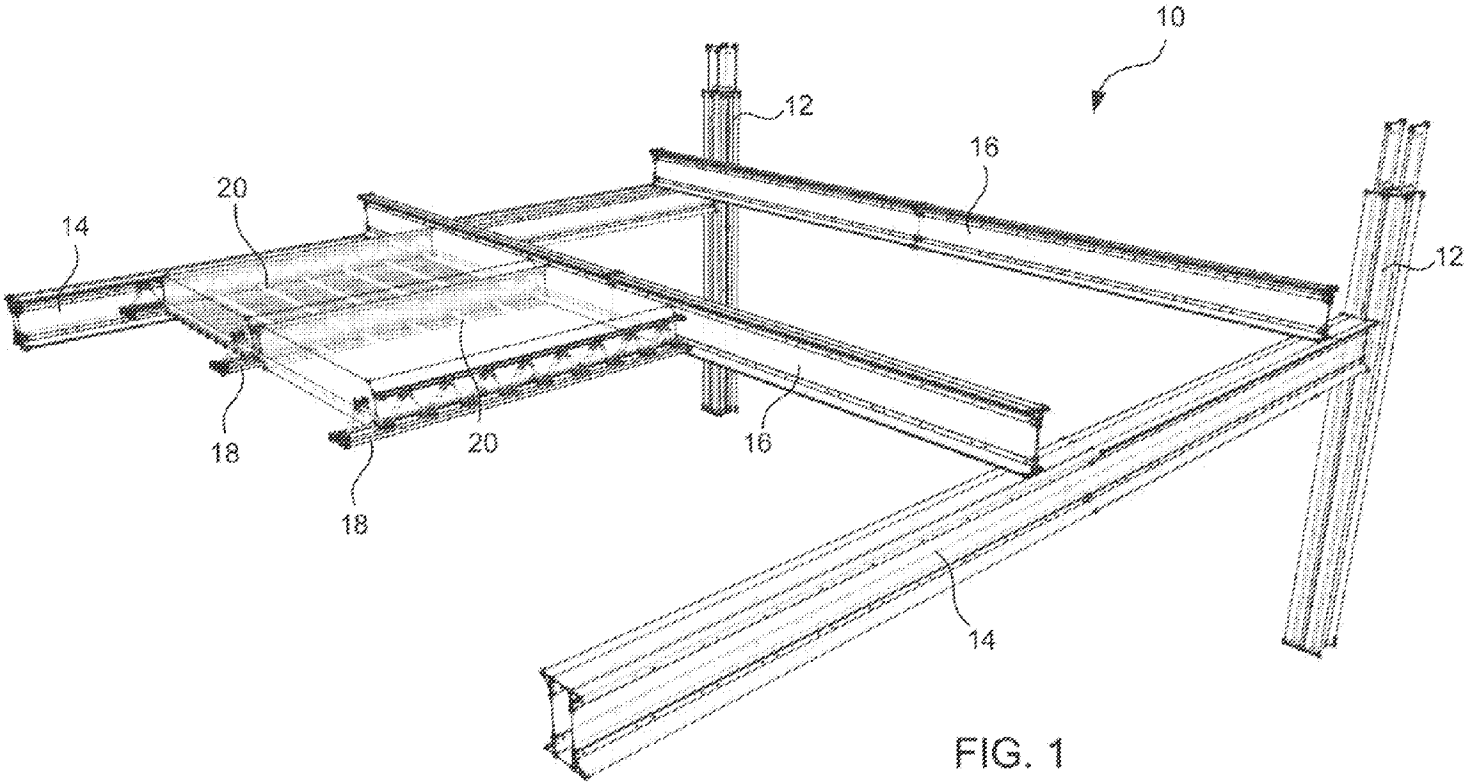
FIG. 1 is am illustration of the cold formed roof structure according to the present invention.

10 . . . Cold formed roof structure
12 . . . Column
14 . . . Girder
16 . . . Beam
18 . . . Open web joist
20 . . . Roof board
22 . . . Upper chord
24 . . . Lower chord
26 . . . Open web
28 . . . Open web member
30 . . . Parallel section
32 . . . Upper-chord-connecting section
34 . . . Lower-chord-connecting section
36 . . . Upper-chord-connecting wall
38 . . . Elongate hollow member
40 . . . Top wall
42 . . . Bottom wall
44 . . . Sidewall
46 . . . Upper panel of the upper chord

48 . . . Lower-chord-connecting wall
50 . . . Lower panel of the lower chord
52 . . . Elongate L-shaped strip
54 . . . Lower-chord-abutting strips
56 . . . Side strip
58 . . . Upper-chord segment member
60 . . . Elongate hollow bar
62 . . . Upper-chord-connecting wall segment
64 . . . Upper panel segment
66 . . . Rectangular bottom strip
68 . . . Angled top strip
70 . . . Rectangular side strip
72 . . . Metal tube segment
74 . . . Elongate hollow member
76 . . . Lower-chord segment member
78 . . . Elongate platform
80 . . . Lower-chord-connecting wall segment
82 . . . Rectangular bottom panel
84 . . . Rectangular flange
86 . . . Bottom panel
88 . . . Side panel
90 . . . Top panel
92 . . . Girder web section
94 . . . Horizontal side
96 . . . Angled side
98 . . . Vertical collar
100 . . . Hollow metal tube
102 . . . Girder flange reinforcing member
104 . . . Girder web
106 . . . Upper girder flange
108 . . . Lower girder flange
110 . . . Fastener
112 . . . Rectangular web panel
114 . . . Horizontal strip
116 . . . First angled strip
118 . . . Second angled strip
120 . . . Beam web
122 . . . Upper beam flange
124 . . . Lower beam flange
126 . . . Horizontal side
128 . . . Vertical strip
130 . . . Angled side
132 . . . Rectangular metal panel
134 . . . Web panel
136 . . . Vertical post
138 . . . Column flange
140 . . . Column web
142 . . . Main side
144 . . . Angled side
146 . . . Vertical strip
148 . . . Main block
150 . . . Top surface
152 . . . Lateral side
154 . . . Longitudinal side
156 . . . Slant side
158 . . . Bottom block
160 . . . Lateral recess
162 . . . Metal pipe
164 . . . Single bottom block

DETAILED DESCRIPTION

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

Figure 2:
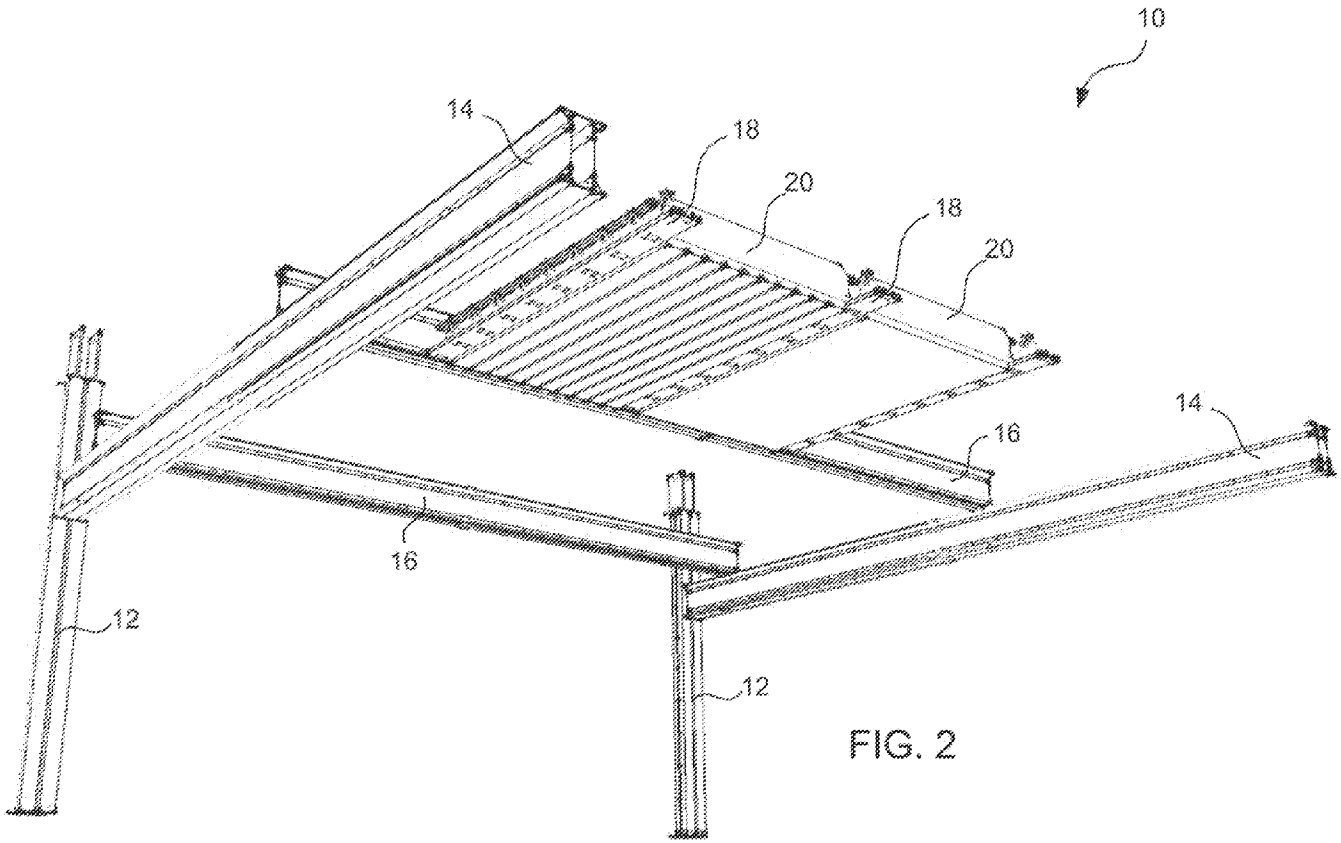
FIG. 2 is another illustration of the cold formed roof structure according to the present invention.

Referring first to FIGS. 1 and 2, the present invention is a cold formed roof structure 10 built of various cold formed structural elements comprising a plurality of cold formed columns 12 supported by a concrete foundation, a plurality of cold formed girders 14 supported by the columns 12, a plurality of cold formed beams 16 supported by the girders 14, a plurality of cold formed joists 18 supported by the beams 16, and finally a plurality of roof boards 20 supported by the joists 18.

Figure 3:
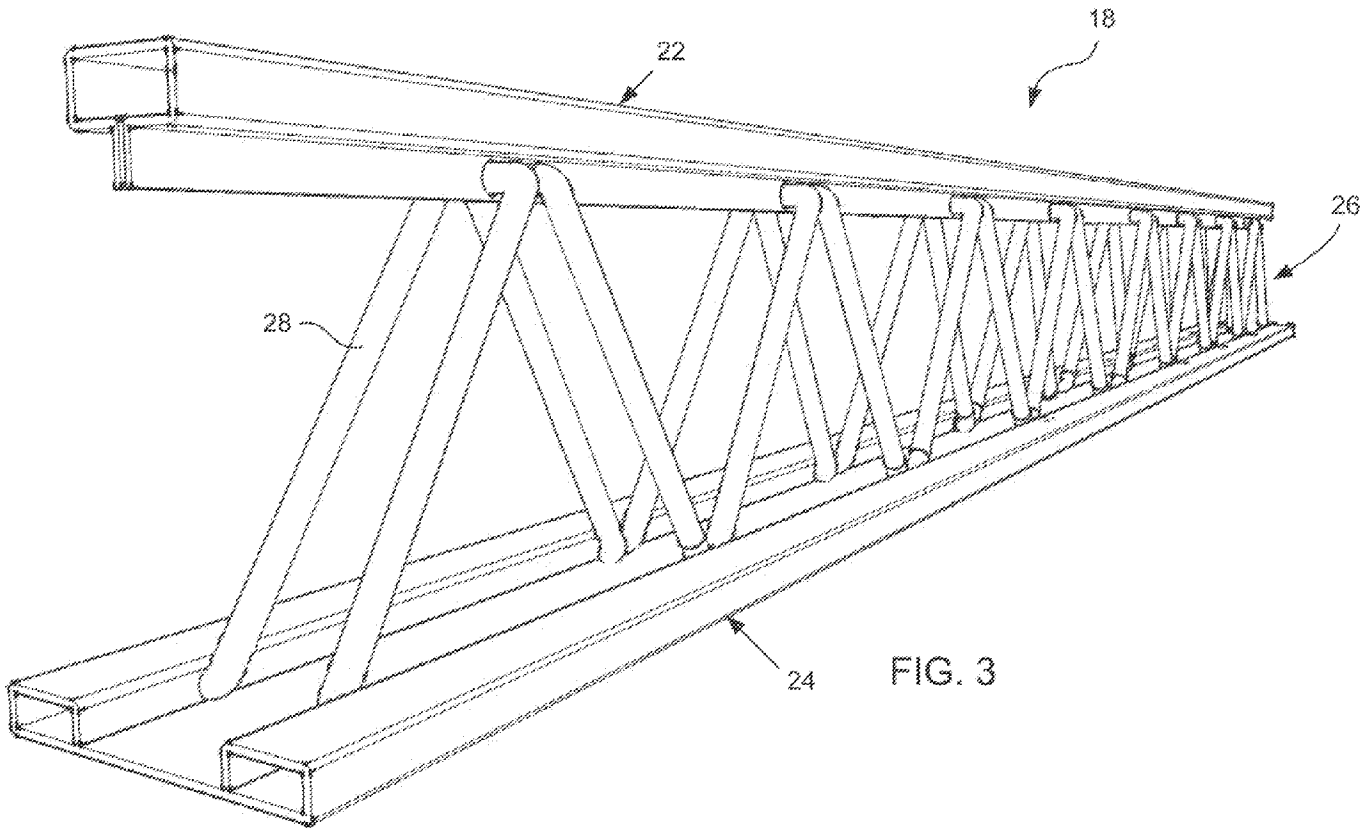
FIG. 3 is an illustration of a perspective view of the preferred embodiment of the open web joist according to the present invention.

Referring to FIG. 3, the joist 18 of the present invention is an open web joist 18 comprising an upper chord 22, a lower chord 24, and a triangulated open web 26 fixedly interconnecting the upper and lower chords, 22 and 24. Every embodiment of the joist 18 is symmetrical about a central vertical cross sectional axis.

Figure 4:
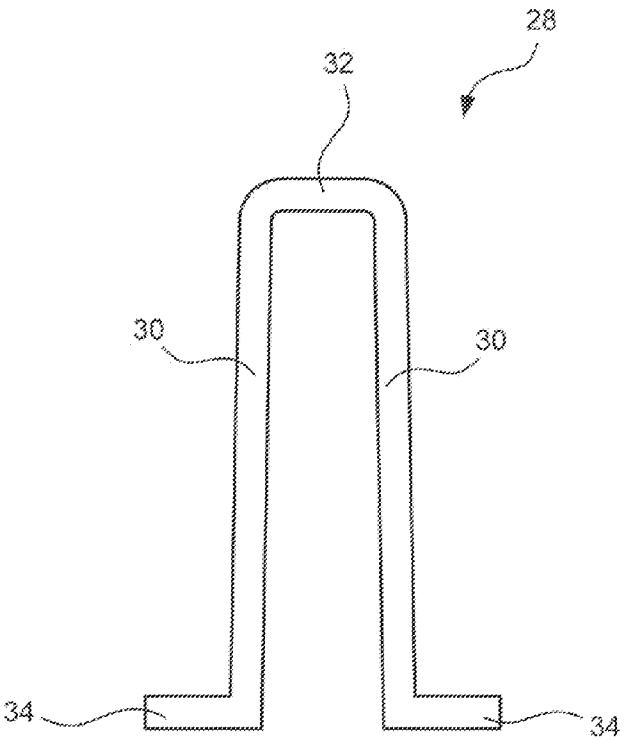
FIG. 4 is an illustration of the plan view of the angled open web member according to the present invention.

Referring to FIGS. 3 and 4, the open web 26 comprises a plurality of angled open web members 28 interconnecting the upper and lower chords 22 and 24. Each open web member 28 is a unitary piece formed by bending a solid metal rod of circular cross section. The open web member 28 comprises a pair of parallel sections 30, each comprising upper and lower ends wherein, the latter are interconnected by an upper-chord-connecting section 32 so as to form a narrow, inverted U-shaped structure. The open web member 28 further comprises a pair of lower-chord-connecting sections 34, each extending perpendicularly and outwardly from the lower ends of the parallel sections 30. As can be implied, the upper and lower chords, 22 and 24, are interconnected by the open web 26 about the plurality of upper and lower-chord-connecting sections 32 and 34 by means of forging.

Still referring to FIGS. 3 and 4, in another embodiment, the connection between the upper and lower chords 22 and 24, and the web members 28 is a rule joint connection. This connection is accomplished by a plurality of medium elements, each comprising a longitudinal groove within which, the upper and lower-chord-connecting sections 32 and 34 are received. The upper and lower chords, 22 and 24, are interconnected by the open web 26 about the plurality of upper and lower-chord-connecting sections 32 and 34 fitted with the medium elements, which are instrumental in forming a rule joint.

Figure 5:
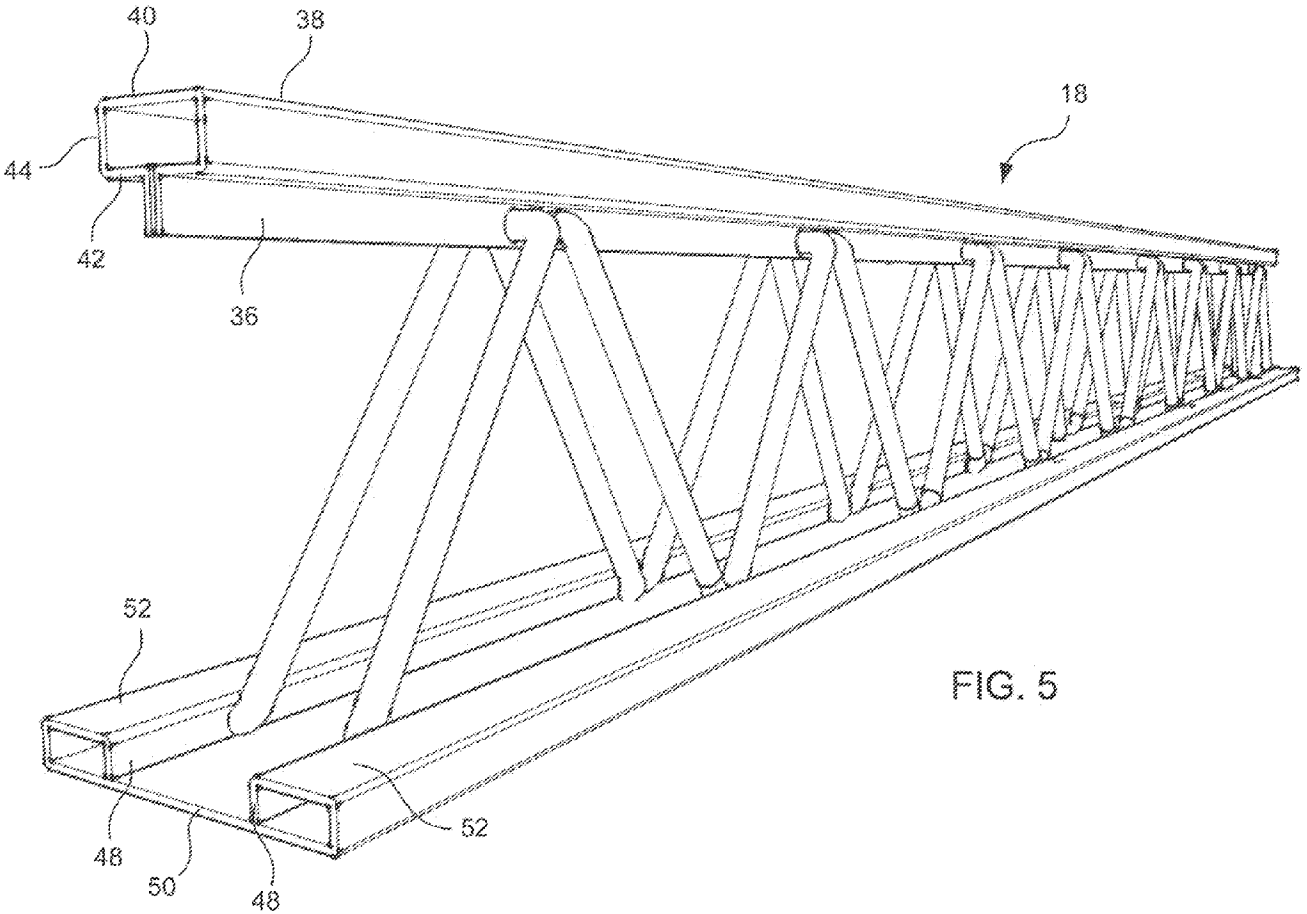
FIG. 5 is an illustration of a perspective view of the preferred embodiment of the open web joist according to the present invention.
Figure 6:
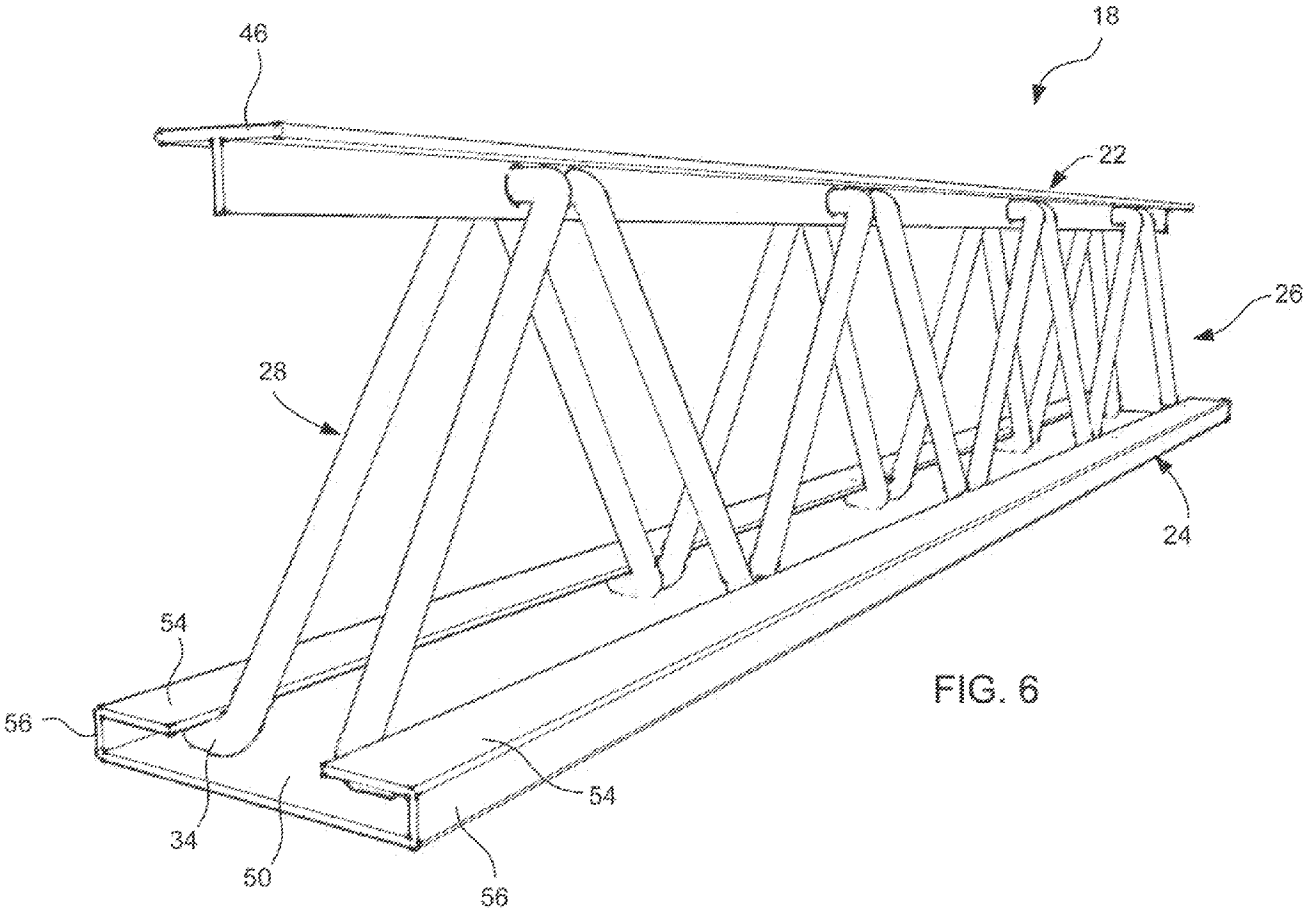
FIGS. 6 through 13 are illustrations of various additional embodiments of the open web joist according to the present invention.
Figure 7:
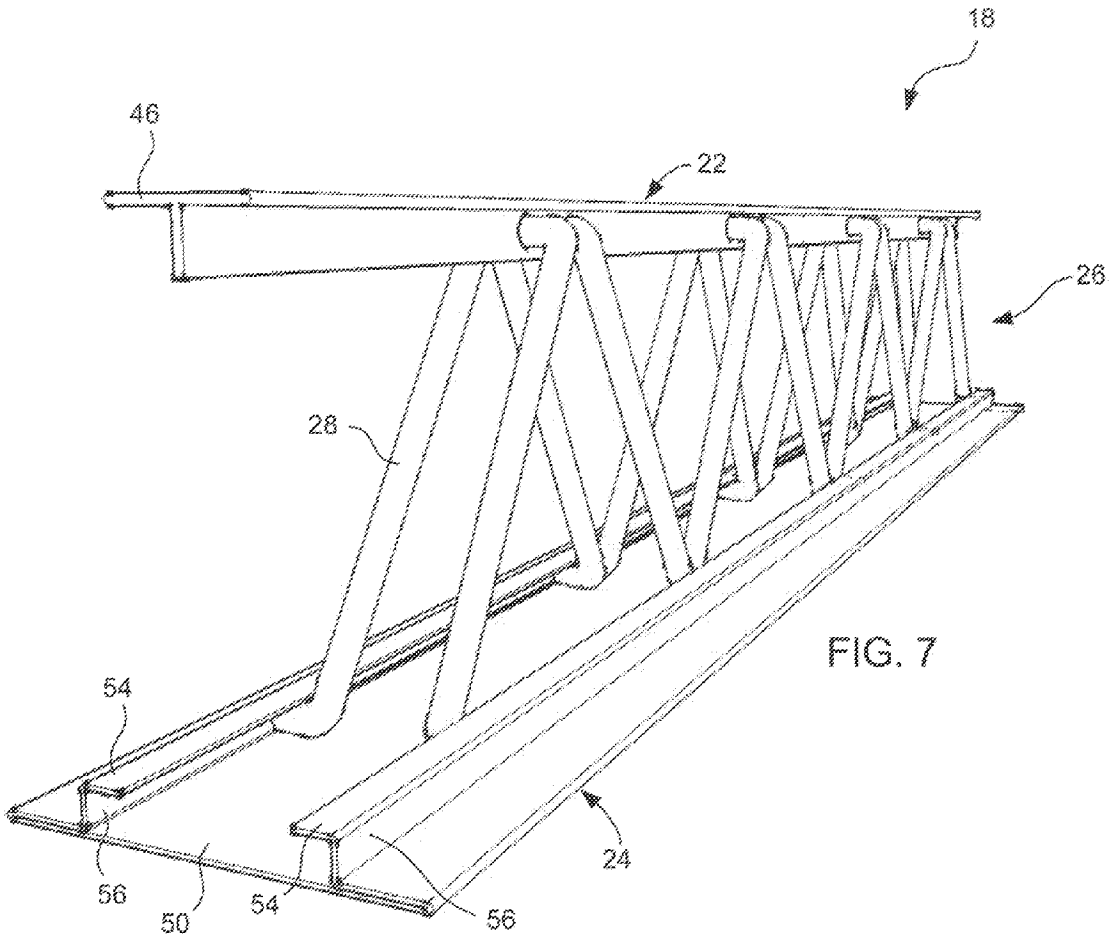
Figure 8:
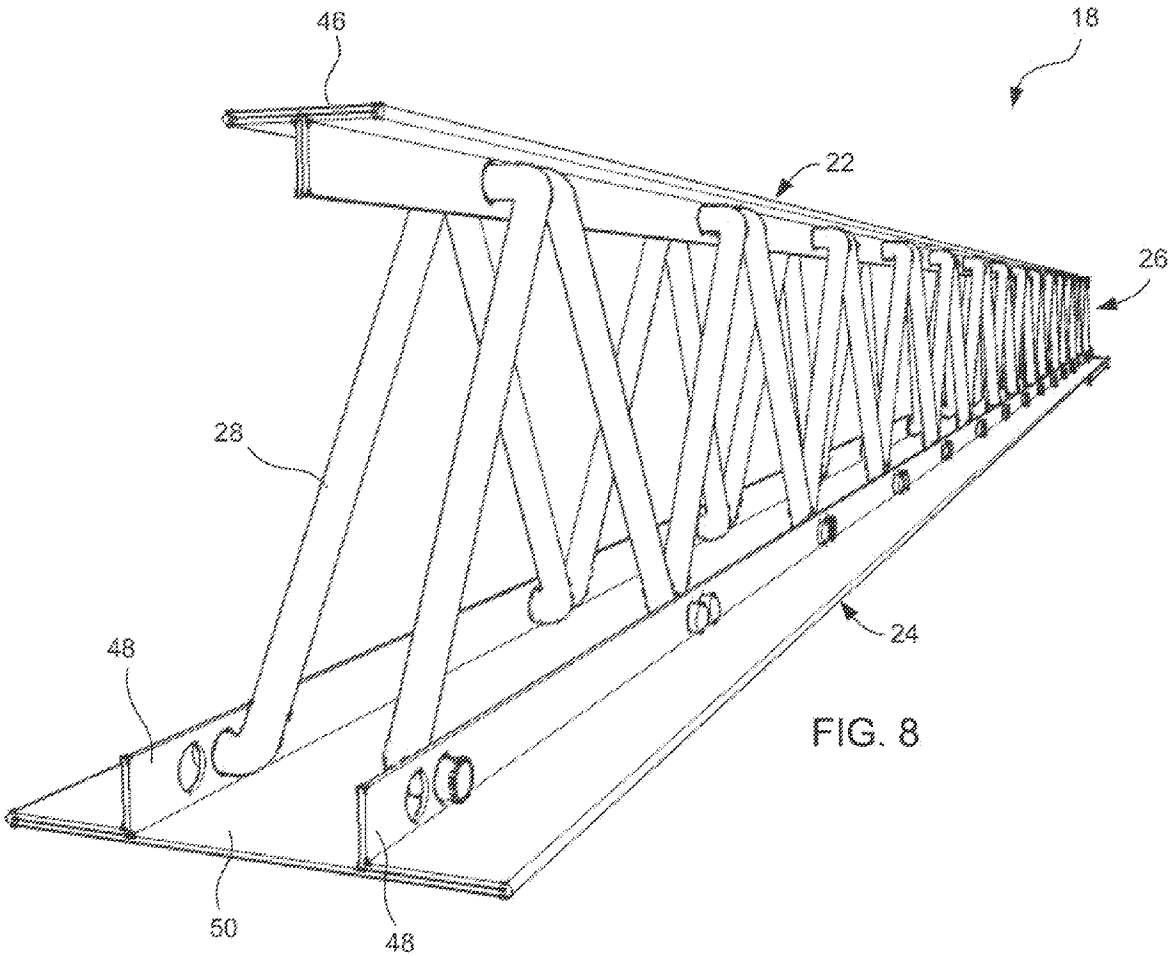

Referring to FIG. 5, the upper chord 22 (FIG. 3) of the joist 18 is a cold formed unitary piece formed by longitudinally bending a metal sheet so as to comprise an elongate, vertical upper-chord-connecting wall 36, in turn, comprising a plurality of equidistant holes for receiving the upper-chord-connecting sections 32 (FIG. 4) therewithin. The upper chord further comprises an elongate hollow member 38 of rectangular cross section attached to the top edge of the upper-chord-connecting wall 36. The elongate member 38 is defined by a pair of elongate, horizontal top and bottom walls 40 and 42, the longitudinal edges of which are interconnected by a pair of elongate, vertical and opposing sidewalls 44. As the upper chord 22 is formed by bending, the thickness of the upper-chord-connecting wall 36 is twice the thickness of any of four depending walls of the elongate member 38. In other embodiments, as seen in FIGS. 6 through 8, the elongate member 38 is replaced by a substantially planar, elongate, rectangular, horizontal, upper panel 46. However, as can be noticed, the upper chord 22 of the embodiments seen in FIGS. 6 and 7 are not formed by bending.

Referring again to FIG. 5, the lower chord 24 of the joist 18 is also a cold formed unitary piece formed longitudinally bending a metal sheet. The lower chord 24 comprises a pair of opposing, elongate, vertical lower-chord-connecting walls 48, each, in turn, comprising a plurality of equidistant holes disposed thereon for receiving the plurality of lower-chord-connecting sections 34 of the open web members 28 (FIG. 4). The lower chord further comprises an elongate, rectangular, horizontal, lower panel 50, and a pair of elongate strips 52 of a substantially 90-degrees-clockwise-rotated L-shaped cross section. The top surface of the lower panel 50 is attached to the bottom edges of the lower-chord-connecting walls 48 whereby, the lower panel 50 extends laterally beyond the connecting point of the pair of lower-chord-connecting walls 48. Each elongate strip 52 interconnects a longitudinal edge of the lower panel 50 and the top edge of a lower-chord-connecting wall 48 so as to form an elongate hollow metal tube of rectangular cross section. As can be noticed from the referred illustration, the pair of lower-chord-connecting walls 48, the lower panel 50, and the pair of elongate strips 52 is of equal thickness.

In another embodiment shown in FIG. 8, the lower chord 24 does not include the pair of elongate strips 52 (FIG. 5). The lower chord 24 of this embodiment is also formed by longitudinally bending a metal sheet, however, the thickness of each portion of the lower panel 50 extending laterally beyond the pair of lower-chord-connecting walls 48 is twice the thickness of the lower-chord-connecting walls 48 or the portion of the lower panel 50 disposed between the pair of lower-chord-connecting walls 48.

Referring to FIG. 6, in another embodiment, the lower chord 24 comprises a pair of elongate, opposing, horizontal, lower-chord-abutting rectangular metals strips 54 attached over the either top surfaces of the plurality of lower-chord-connecting sections 34. The lower chord 24 further comprises an elongate, horizontal, rectangular lower panel 50 and a pair of opposing, elongate, vertical, rectangular side strips 56 interconnecting the longitudinal edges of the pair of lower-chord-abutting strips 54 and the lower panel 50. The lower chord 24 of this embodiment is formed by bending a metal sheet such that the lower-chord-abutting strips 54, lower panel 50, and the side strips 56 are of equal thickness.

In another embodiment shown in FIG. 7, the lower chord 24 comprises a pair of elongate, opposing, horizontal, lower-chord-abutting rectangular metals strips 54 attached over the either top surfaces of the plurality of lower-chord-connecting sections 34. The lower chord 24 further comprises an elongate, horizontal, rectangular lower panel 50 and a pair of opposing, elongate, vertical, rectangular side strips 56, each interconnecting the longitudinal edge of a lower-chord-abutting strip 54 and the top surface lower panel 50 whereby, the lower panel 50 extends laterally beyond the connecting point of the pair of side strips 56. The thickness of each portion of the lower panel 50 extending laterally beyond the pair of side strips 56 is twice the thickness of the side strips 56, or the thickness of the portion of the lower panel 50 disposed between the pair of side strips 56, or the thickness lower-chord-abutting strips 54.

Figure 9:
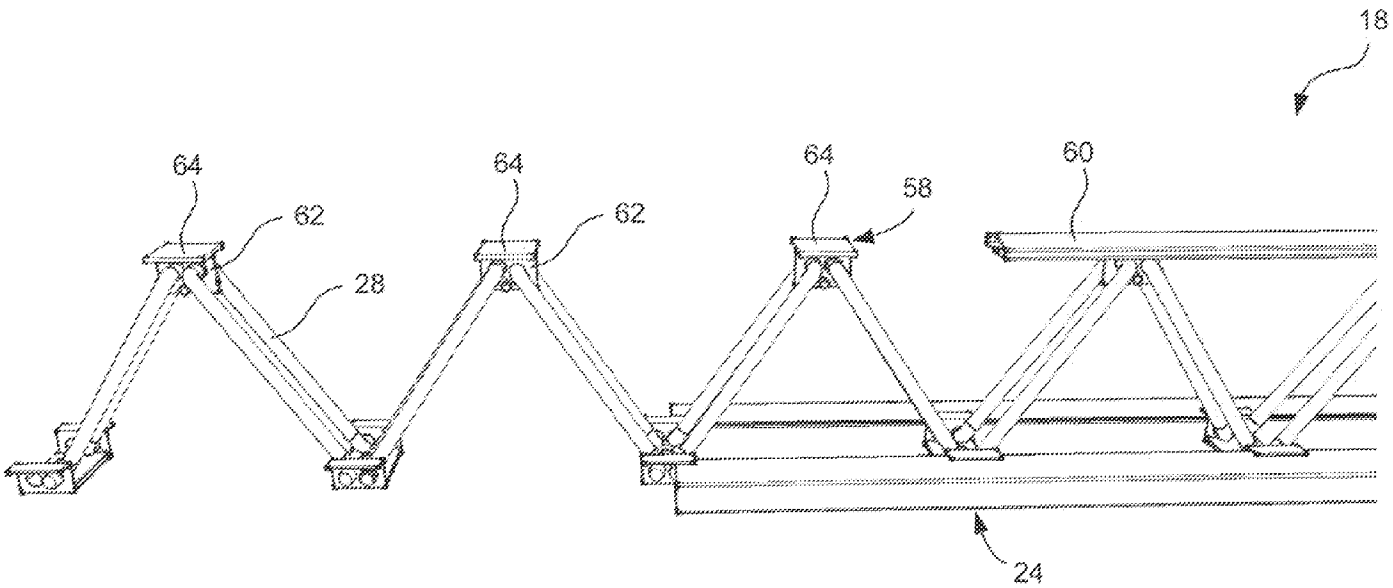
Figure 10:
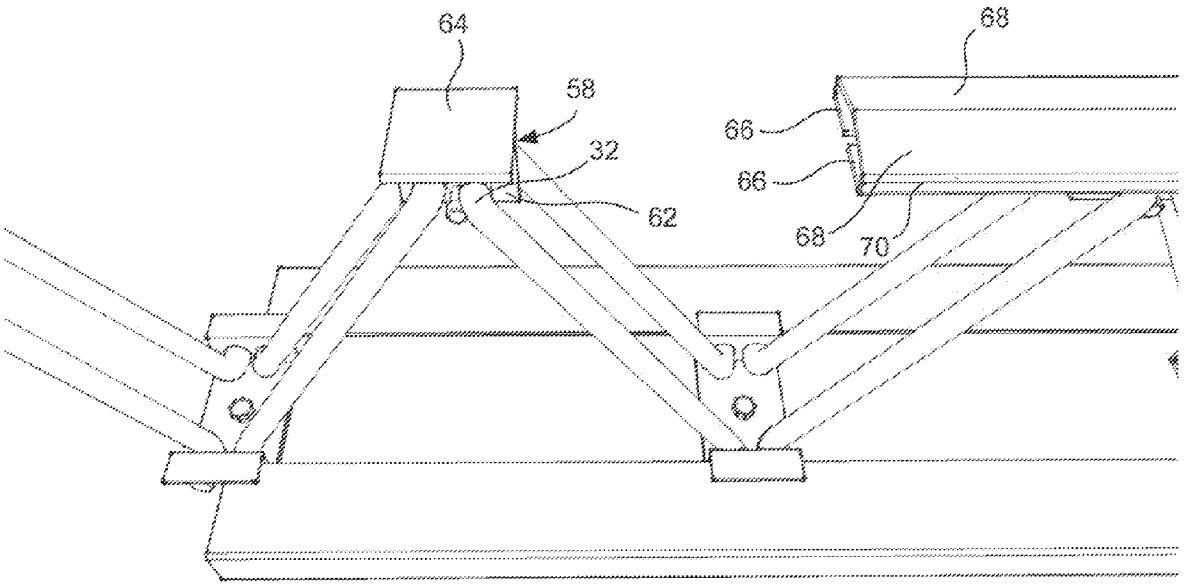

Referring to FIGS. 9 and 10, in another embodiment, the upper chord 22 comprises a plurality of upper-chord segment members 58 attached to an elongate hollow bar 60. Each upper-chord segment member 58 comprises an upper-chord-connecting wall segment 62 that includes a hole for receiving an upper-chord connecting section 32 therewithin. More particularly, the upper-chord-connecting wall segment 62 comprises a vertically disposed rectangular metal panel. The upper-chord segment member further comprises an upper panel segment 64 comprising a horizontally disposed rectangular metal panel. The upper panel segment 64 is attached to the top edge of the upper-chord-connecting wall segment 62.

Still referring to FIGS. 9 and 10, the elongate hollow bar 60 comprises a pair of opposing, elongate, horizontal, rectangular bottom strips 66 attached over the top surface of the plurality of upper-chord segment members 58. The elongate hollow bar 60 further comprises pair of elongate, longitudinally-connected, angled top strips 68 wherein, the extreme longitudinal edges of the bottom strips 66 and the longitudinal edges of the angled top strips 68 are interconnect a pair of elongate, opposing, vertical, rectangular side strips 70. The angle between the each angled top strip 68 and its corresponding side strip 70 is substantially obtuse whereby, the cross section of the angled top strips 68 is substantially gable-like. The hollow bar is formed by bending a metal sheet such that the pair of bottom strips 66, side strips 70, and top strips 68 are of equal thicknesses.

Figure 11:
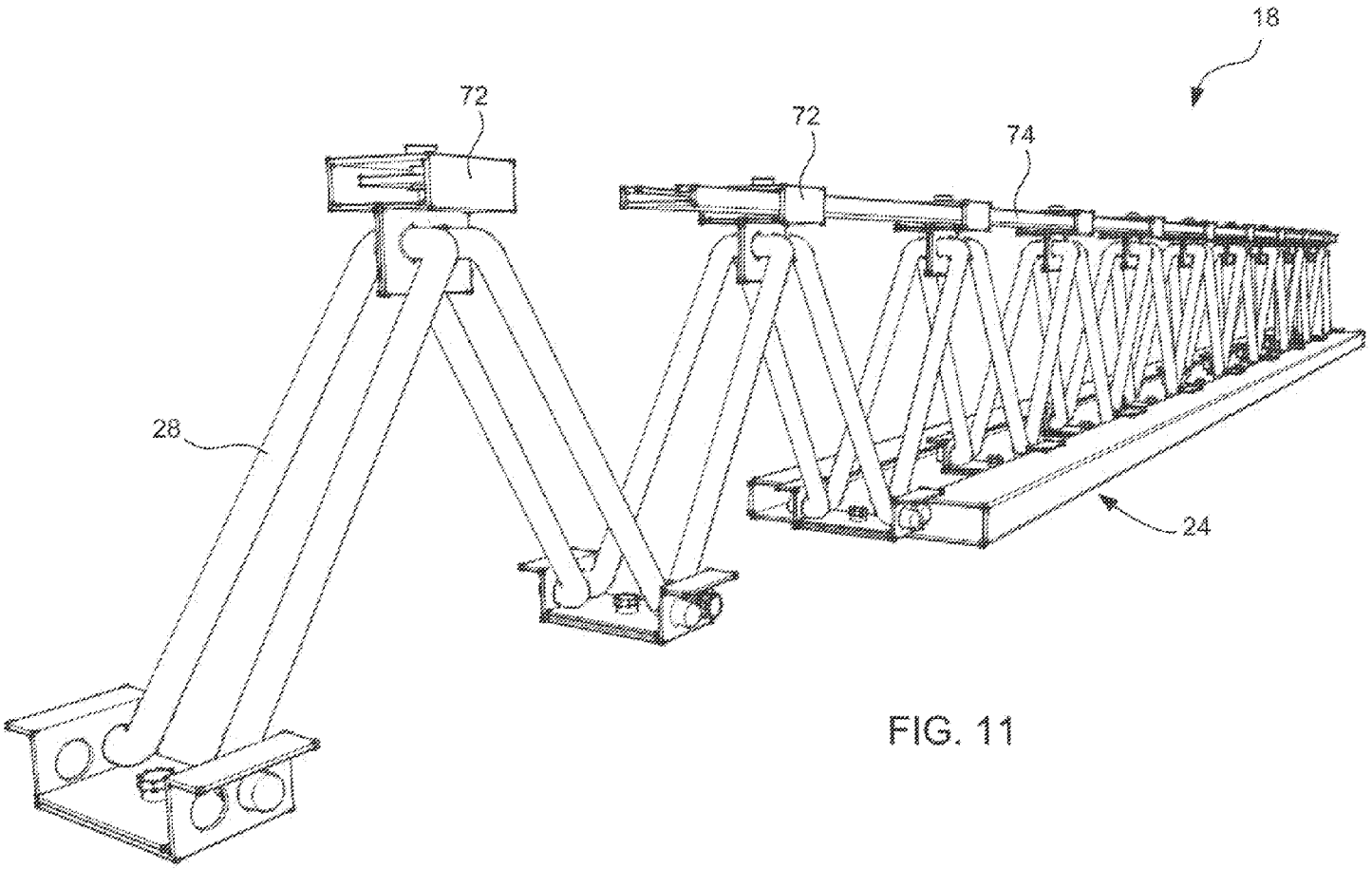

In another embodiment shown in FIG. 11, the upper panel segments of the embodiment seen in FIGS. 9 and 10 is replaced by a plurality of metal tube segments 72, each of rectangular cross section comprising a top wall, a bottom wall, and a pair of sidewalls interconnecting the edges of the top and bottom walls so as to form a hollow tube wherein, the bottom wall is perpendicular to the upper-chord-connecting wall segment 62. An elongate hollow member 74 is to be fixedly received through the metal tube sections. The elongate hollow member is defined by a pair of elongate, horizontal top and bottom walls, and a pair of elongate, vertical and opposing sidewalls interconnecting the longitudinal edges of the top and bottoms walls.

Figure 12:
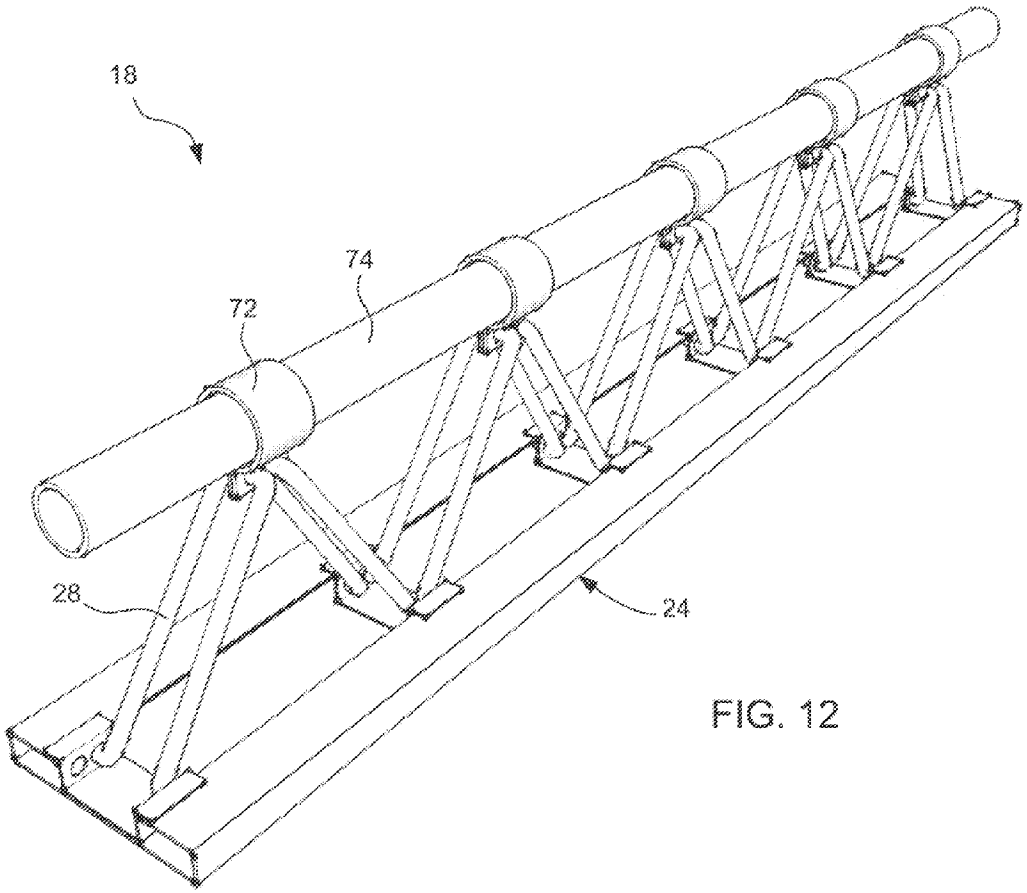
Figure 13:
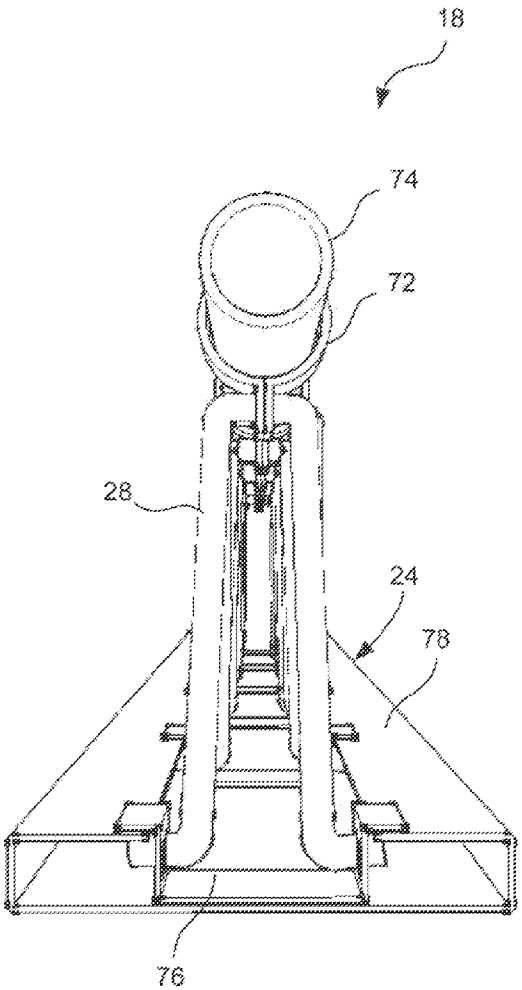

In another embodiment shown in FIGS. 12 and 13, the plurality of metal tube segments 72 and the elongate hollow member 74 are of circular cross sections. In the embodiments (FIGS. 11 through 13), the metal tube segments 72 and the elongate hollow member 74 are formed by bending metal sheet s.

Figure 14:
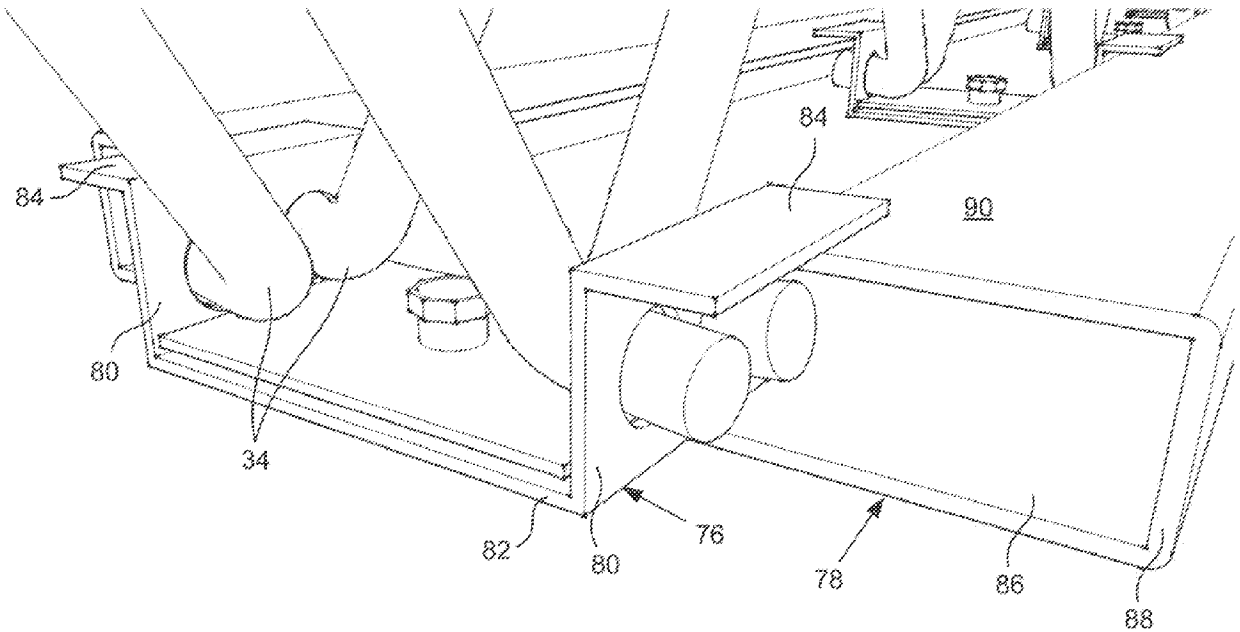
FIG. 14 is an illustration of a closer perspective view of the bottom chord of an additional embodiment of the open web joist according to the present invention.

Referring to FIGS. 13 and 14, in another embodiment, the lower chord 24 comprises a plurality of lower-chord segment members 76 and an elongate platform 78 within which, the plurality of lower-chord segment members 76 are fixedly received. Each lower-chord segment member 76 comprises a pair of lower-chord-connecting wall segments 80, each defined by a vertical, rectangular strip. Each of the lower-chord-connecting wall segments 80 comprises a hole thereon for receiving a pair of lower-chord-connecting sections 34 therethrough. The lower-chord segment member 76 further comprises a horizontally disposed, rectangular bottom panel 82 interconnecting the bottom edges of the pair of lower-chord-connecting wall segments 80 so as to form a wide substantially U-shaped structure. A pair of horizontal rectangular flanges 84 extends from the top edges of the lower-chord-connecting wall segments 80. The lower-chord segment members are made by bending metal sheet.

Still referring to FIGS. 13 and 14, the elongate platform 78 comprises an elongate rectangular bottom panel 86, a pair of elongate, vertical, side panels 88 extending from the longitudinal edges of the bottom panels 86, and a pair of elongate, horizontal top panels 90, each extending inwardly from the top edge of a side panel 88. The plurality of lower chord segment members 76 are received within the elongate platform 78 such that the bottom panels 82 of the plurality of lower-chord segment members 76 abut the top surface of the bottom panel 86 of the elongate platform 78 and the pair of rectangular flanges 84 of each lower-chord segment member 76 abut the top surface of the pair of top panels 90 of the elongate platform 78. The elongate platform 78 is formed by bending a metal sheet such that the bottom panel 86, the pair of side panels 88, and the pair of top panels 90 are of equal thicknesses.

Figure 15:
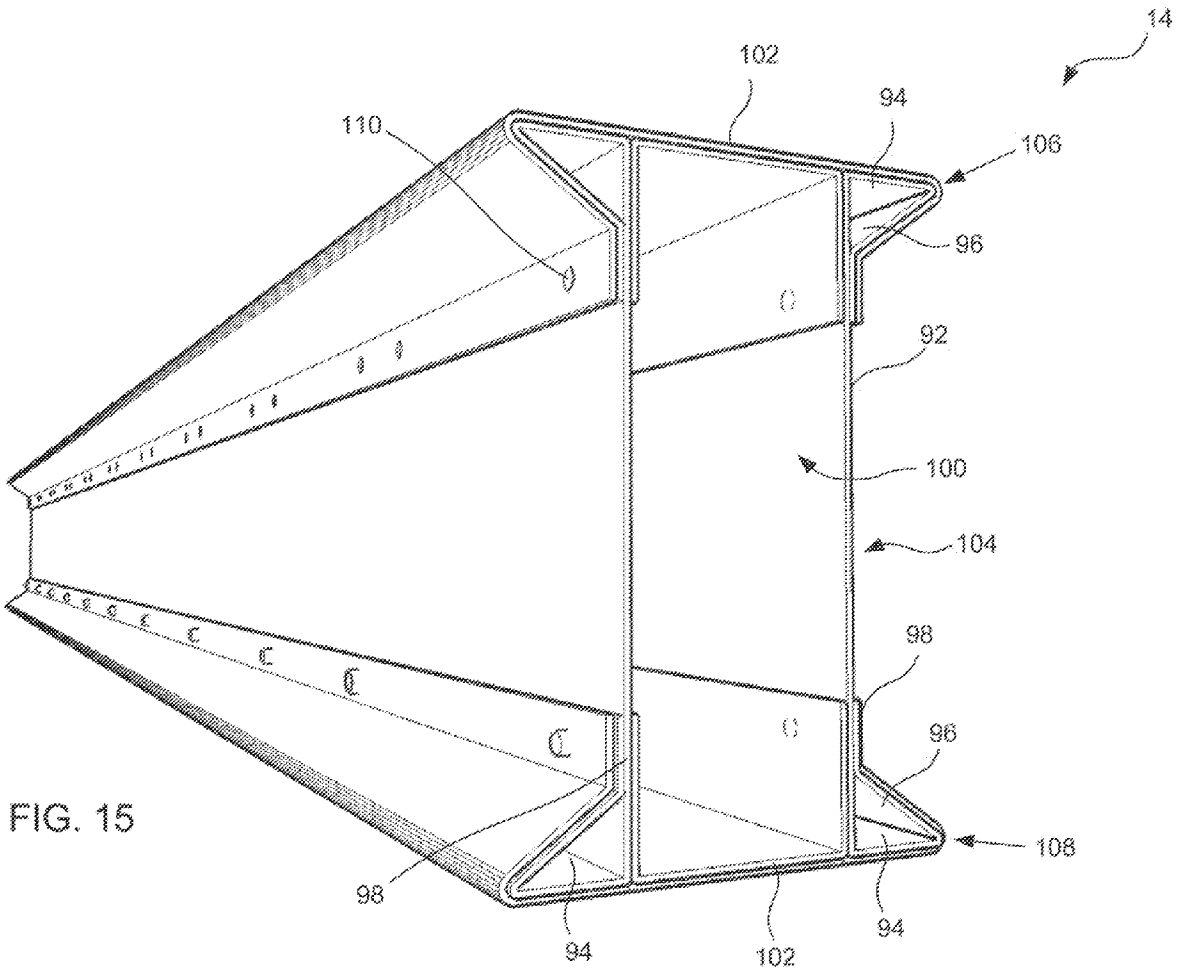
FIG. 15 is an illustration of a perspective view of the preferred embodiment of the girder according to the present invention.

Referring to FIGS. 1 and 2, the girders supported by the plurality of columns comprise tapered I-beams comprising a girder web 104 interconnecting upper and lower girder flanges 106 and 108. The girders are formed by bending metal sheet s. Referring to FIG. 15, the preferred embodiment of the girder 14 is formed by longitudinally bending each elongate metal sheet from a pair of elongate metal sheets at first and second points so as to form an elongate, vertical girder web section 92 and a pair of elongate, opposing, upper and lower horizontal girder flange sections extending from the top and bottom edges of the girder web section. The first and second points are located at an equal distance from the first and second longitudinal edges of the metal sheet respectively. Further, the upper and lower girder flange sections are longitudinally bent at an acute angle at third and fourth points respectively so as to form a pair of elongate, opposing horizontal sides 94, a pair of elongate, opposing, angled panels, each extending from a longitudinal edge of a horizontal side. The third and fourth points are located at an equal distance from the first and second longitudinal edges of the metal sheet respectively.

The upper and lower elongate angled panels are longitudinally bent outwardly and away from the girder web section at fifth and sixth points respectively, so as to form a pair of elongate, opposing angled sides 96 and a pair of elongate, vertical collars 98, each extending from the longitudinal edge of an angled side. The inner surfaces of the vertical collars 98 fixedly abut the surface of the girder web section 92 by means of welding or by fasteners 104 such as rivets, bolts, etc. The planar sides of the finally bent metal sheets are attached to the either, opposing, planar sides of a hollow elongate metal tube 100 of rectangular cross section. More particularly, bent metal sheets are attached to the rectangular metal tube 100 so as to form a tapered I-beam being symmetrical about horizontal and vertical cross sectional central axes.

Further, the girder 14 further comprises a pair of elongate girder flange reinforcing members 102, each formed by bending a metal sheet such that, the inner surface thereof conforms to the outer surfaces of the opposing vertical collars 98, the angled sides 96, the horizontal sides 94, and the top surface of the hollow metal tube 100 of the girder web.

Figure 16:
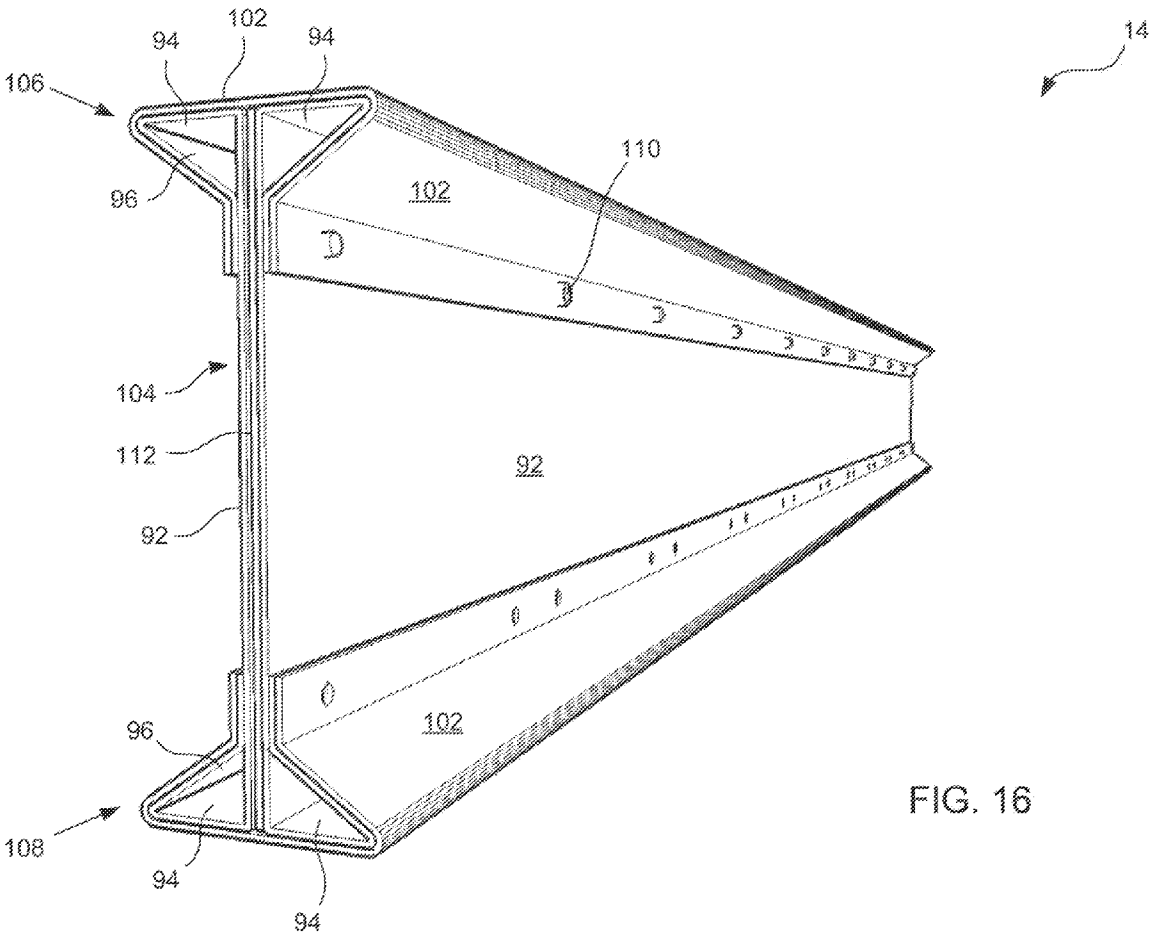
FIGS. 16 through 18 are illustrations of various embodiments of the girder according to the present invention.
Figure 17:
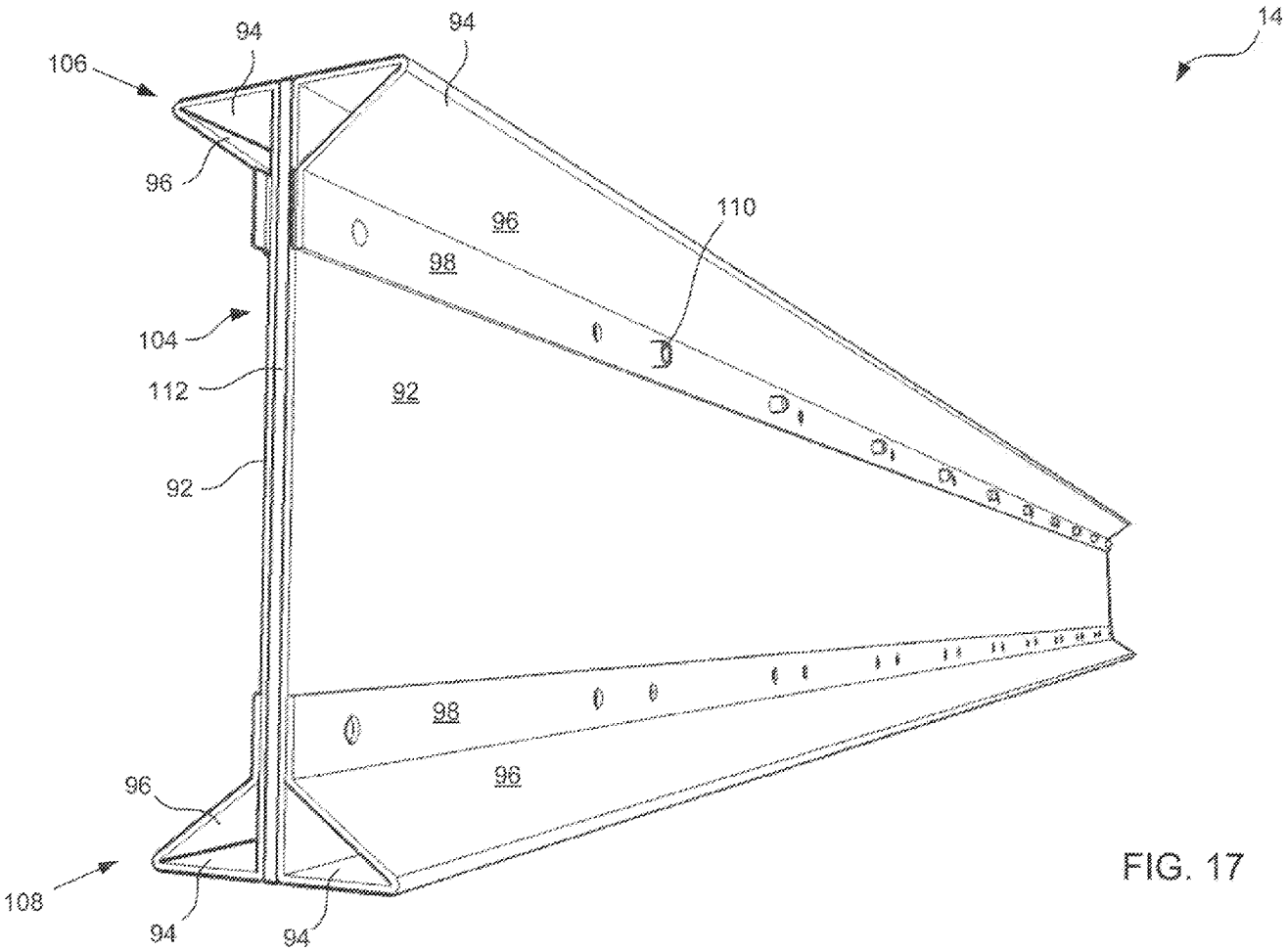

In another embodiment of the girder, the hollow elongate metal tube 100 of rectangular cross section pertaining to the preferred embodiment of the girder 14 shown in the earlier FIG. 15 is replaced by an elongate, vertical rectangular web panel 112. FIGS. 16 and 17 depict these embodiments with and without the girder flange reinforcing members 102 respectively.

Figure 18:
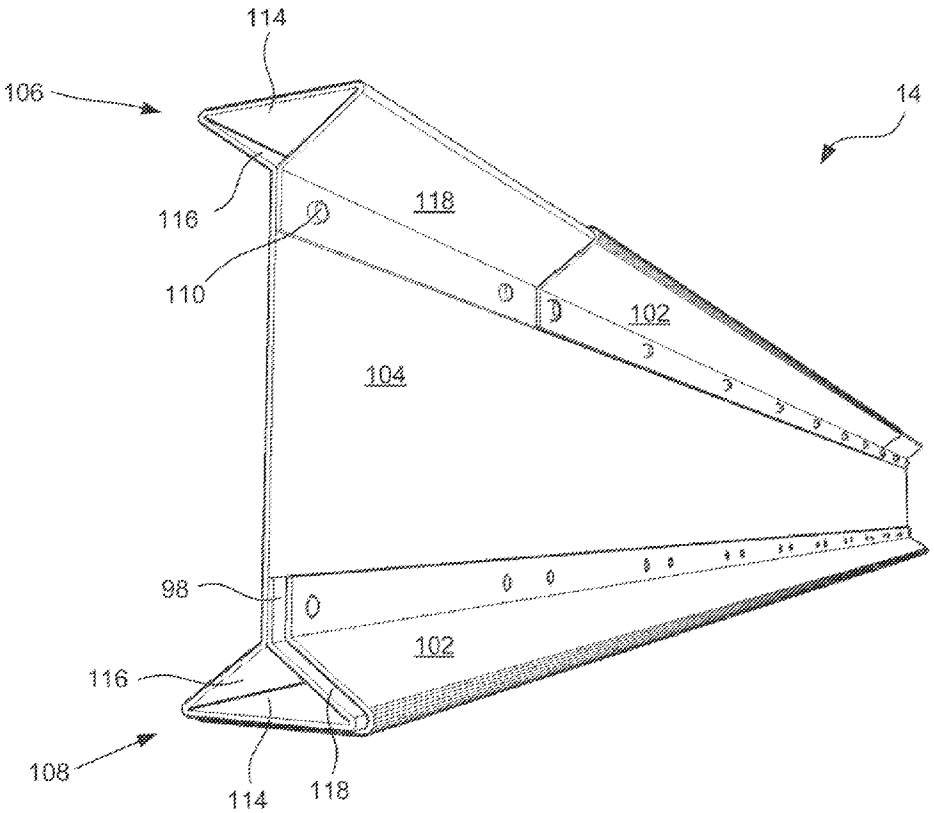

In another embodiment shown in FIG. 18, the girder 14 can be formed by longitudinally bending a metal sheet so as to form a pair of upper and lower hollow girder flanges 106 and 108 of uniform triangular cross sections. Each of the upper and lower flanges 106 and 108 is defined by an elongate horizontal strip 114, and first and second elongate angled strips 116 and 118 extending from the longitudinal edges of the horizontal strip 114. The girder further comprises an elongate, vertical, girder web 104 interconnecting the edges of the pair of first angled strips 116, and a pair of vertical elongate collars 98 extending from the edges of the pair second angled strips 118 wherein, the collars 98 fixedly abut the web 104 as facilitated by the fasteners 110 such as rivets, bolts, etc.

The girder further includes a pair of elongate girder flange reinforcing members 102, each comprising inner and outer surfaces. The flange reinforcing members 102 are made by longitudinally bending a metal sheet such that the cross-sectional thickness of each reinforcing member 102 is uniform. The inner surface of each reinforcing member 102 conforms and fixedly abuts the outer surface of a girder flange 106, the surface of the collar 98, and the surface of a portion of the girder web 104 opposite to the collar 98.

Figure 19:
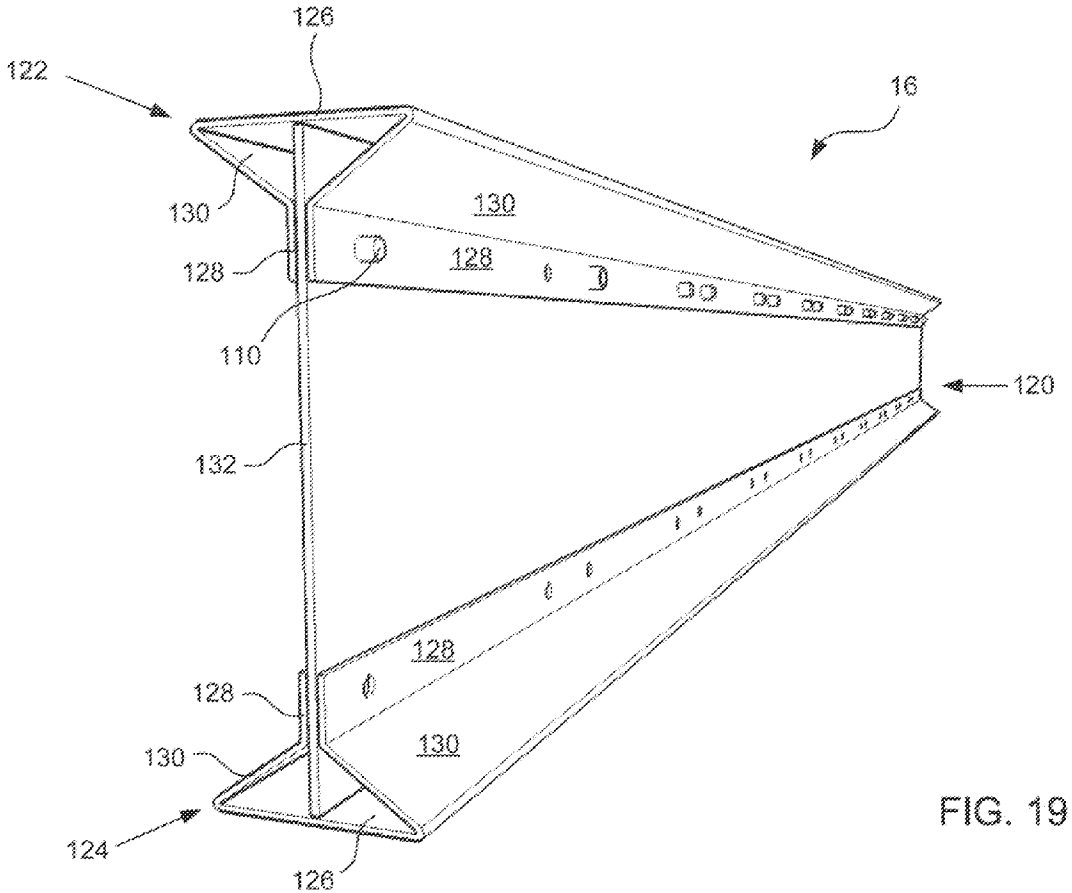
FIG. 19 is an illustration of a perspective view of the preferred embodiment of the beam according to the present invention.

Again referring to FIGS. 1 and 2, the beams 16 supported by the plurality of columns 14 are tapered I-beams comprising a beam web 120 interconnecting upper and lower beam flanges 122 and 124. The beams 16 are formed by bending metal sheet s. Referring to FIG. 19, the preferred embodiment of the beam 16 is formed by longitudinally bending each elongate metal sheet from a pair of elongate metal sheets at first and second points at an acute angle so as to form an elongate, horizontal side 126, and a pair of elongate angled panels depending from the longitudinal edges of the horizontal side 126. The first and second points are located at an equal distance from first and second longitudinal edges of the metal sheet. Further, the angled panels are longitudinally bent outwardly at third and fourth points so as to form a pair of opposing, vertical strips 128 and a pair of opposing angled sides 130 interconnecting the longitudinal edges of the horizontal side 126 and the vertical strips 128. The third and fourth points located at an equal distance from the first and second longitudinal edges of the metal sheet.

Still referring to FIG. 19, the inner surfaces of the vertical strips 128 abut and are attached to the opposing outer surfaces of an elongate vertical, rectangular metal panel 132 such that the top and bottom edges of the metal panel 132 abut the inner surfaces of the top and bottom beam flanges 122 and 124 respectively. The opposing vertical strips 128 pertaining to the upper and lower beam flanges 122 and 124 are secured to the metal panel 132 by means of welding or by fasteners 110 such as bolts, rivets, etc.

Figure 20:
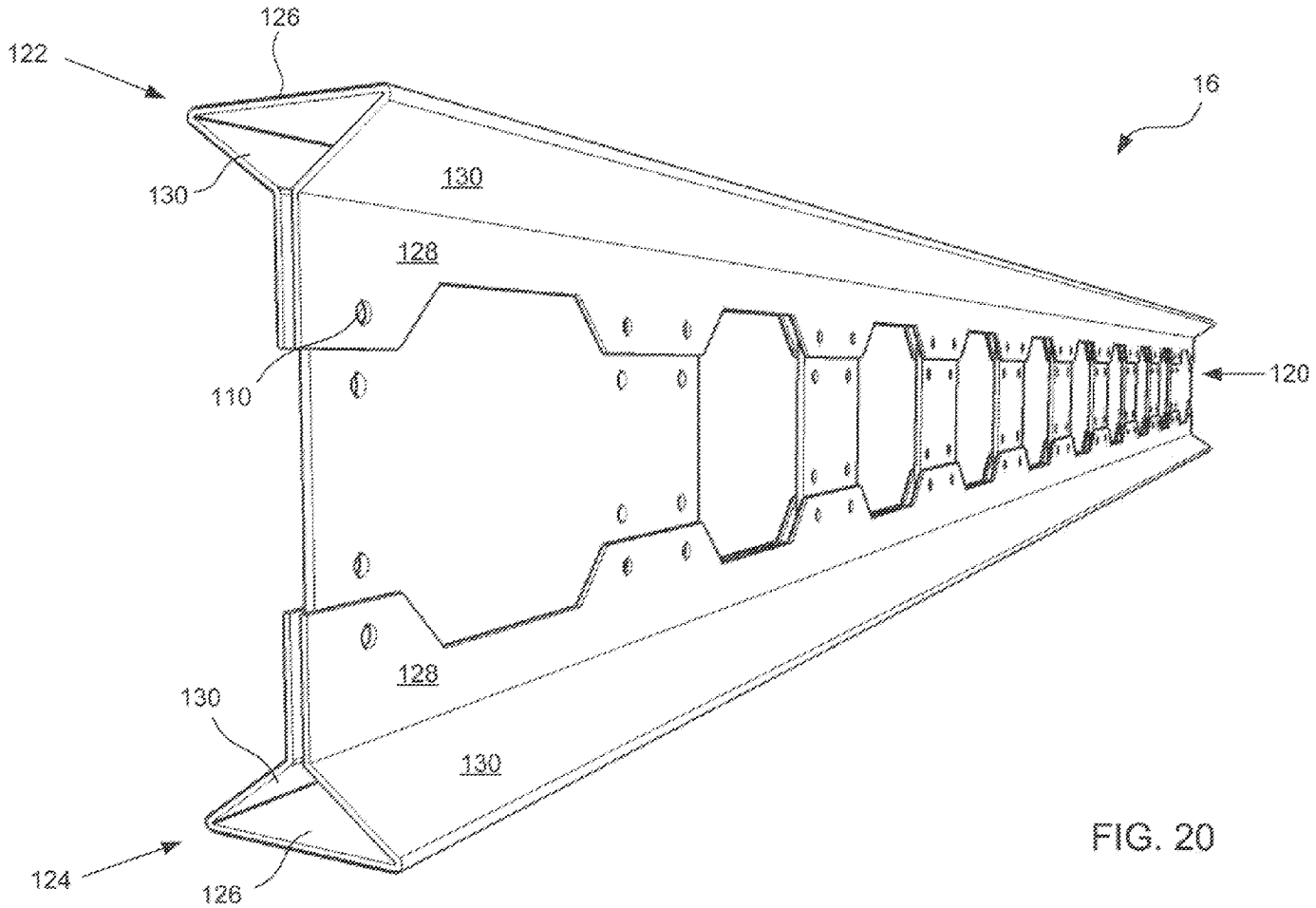
FIG. 20 is an illustration of a perspective view of an additional embodiment of the beam according to the present invention.

In another embodiment shown in FIG. 20, the longitudinal edge of each vertical strip 128 of the top and bottom beam flanges 122 and 124 of the preferred embodiment of the beam 16, shown in FIG. 16, comprises a series of web-connecting edges, a series of non-web-connecting edges wherein, each non-web-connecting edge is disposed between a pair of web-connecting edges. An angled edge interconnects every successive web-connecting and non-connecting edge. A vertical, rectangular, web panel 134 is fixedly received between the inner surfaces extending from each pair of opposing web-connecting edges of the pair of vertical strips 128 of each of the upper and lower beam flanges 122 and 124. The plurality of rectangular web panels 134 serves as the beam web 120.

The preferred and additional embodiments of the beam 16 as depicted by FIGS. 19 and 20 can also serve as the additional embodiments of the girder 14. Likewise, the preferred and additional embodiments of the girder 14 as depicted by FIGS. 15 through 18 can also serve as the additional embodiments of the beam 16.

Figure 21:
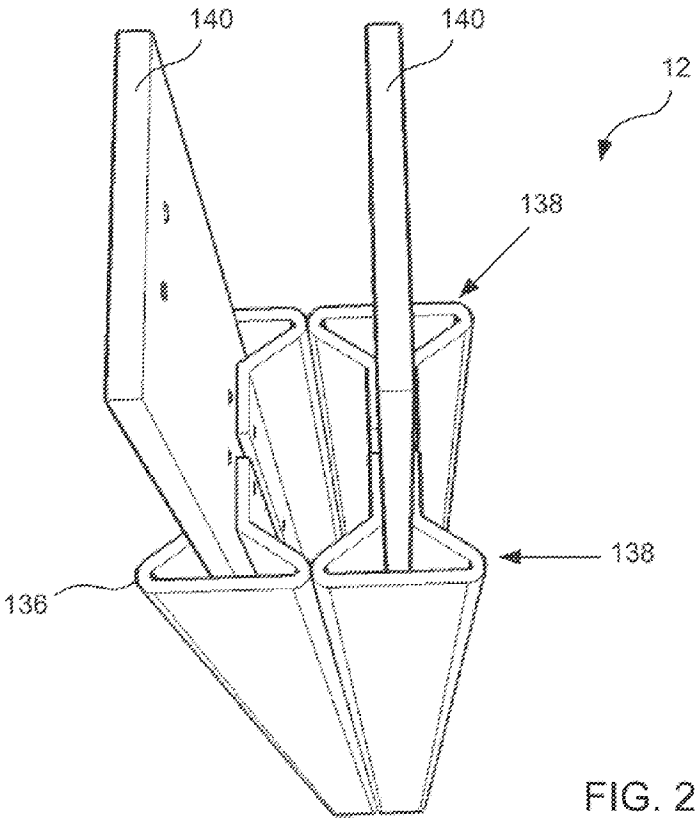
FIG. 21 is an illustration of a perspective view of the column according to the present invention.
Figure 22:
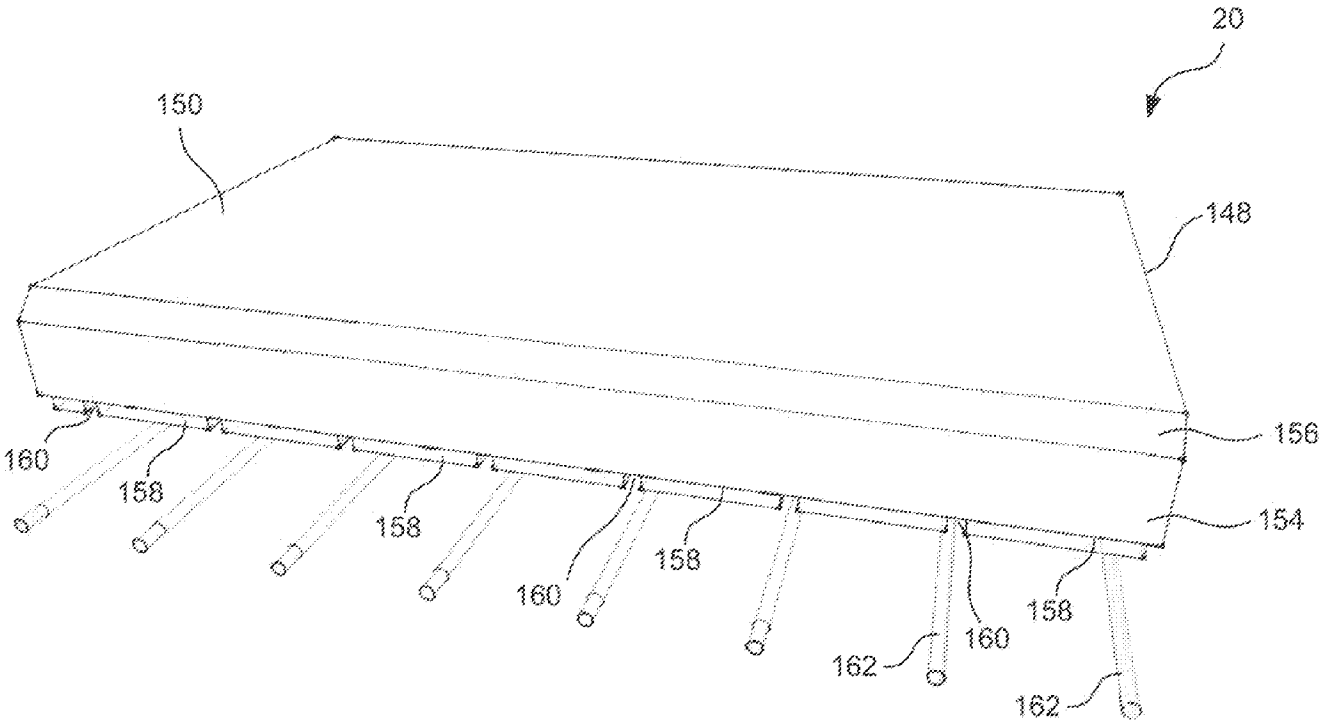
FIGS. 22 and 23 are different illustrations of the preferred embodiment of the roof board according to the present invention.
Figure 23:
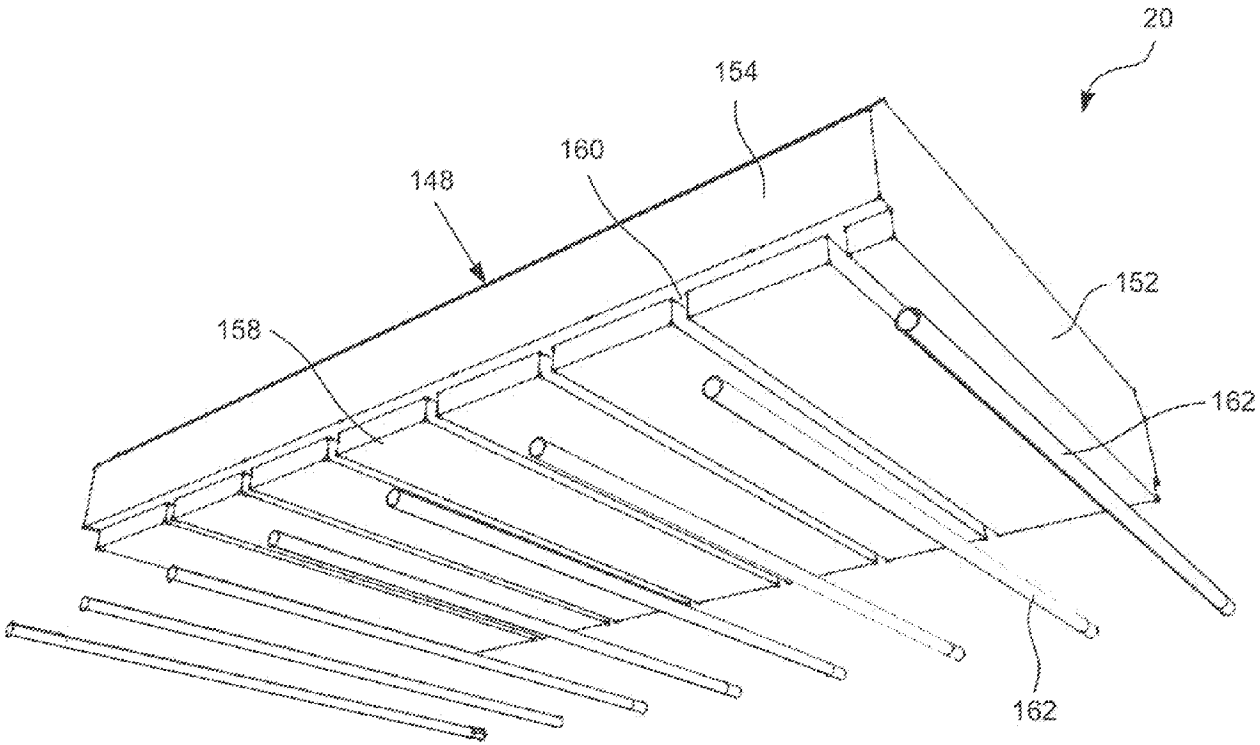

Referring to FIGS. 1, 2, and 21, each column 12 supported by a concrete foundation comprises a pair of longitudinally attached vertical posts 136 comprising a substantially tapered I-shape cross-section. Each post 136 comprises a pair of column flanges 138 and an interconnecting column web 140. Each column flange 138 is formed by longitudinally bending an elongate, metal sheet at an acute angle at first and second points so as to form an elongate, rectangular main side 142 and a pair of elongate rectangular angled panels, each extending from an elongate edge of the main side 142. The first and second points located at an equal distance from first and second elongate edges of the metal sheet respectively.

Referring to FIG. 21, the process of forming the column flange further comprises longitudinally bending the pair of angled panels outwardly at third and fourth points so as to form a pair of elongate angled sides 144, and a pair of elongate strips 146 substantially perpendicular to the main side 142 of the column flange 138. The third and fourth points are located at an equal distance from the first and second elongate edges respectively.

Still referring to FIG. 21, the inner surfaces of the pair of vertical strips 146 of each column flange 138 fixedly abut the outer opposing surfaces of the column web 140 so as to resemble the preferred embodiment of the beam 16 shown in FIG. 19. Also, the column web 140 of each vertical post 136 extends upward beyond the length of the column flanges 138 as shown in the figure. The pair of vertical posts 136 fixedly abut about the corners of the column flanges 138 such that the column web 140 of either vertical post 136 are disposed in a parallel opposing relation. Unlike what is seen in the case of girders 14 and beams 16, the metal sheet s employed for making the columns 12 are substantially thicker than the metal sheets used for girders 14 and beams 16. Another difference between the girders 14 and beams 16, and the columns 12 is that the column web 140 is substantially narrower as compared to that of the girders 14 and beams 16.

The metal sheets employed for forming the structural elements of the present invention are preferably ST32 and ST57 sheets, and galvanized and black sheet of different thicknesses. As a part of forming these sheets into desired structural elements, they are processed through Berck pressing machine or role forming machine.

Referring to FIGS. 1, 2, 22, and 23, each roof board 20, preferably made of light polystyrene, comprises a main solid block 148 defined by a rectangular bottom surface, a substantially planar rectangular top surface 150, a pair of vertical lateral sides 152 interconnecting the lateral edges of the top 150 and bottom surfaces, a pair of vertical longitudinal sides 154 extending upwardly from a longitudinal edges of the bottom surface, and a pair of longitudinal slant sides 156, each interconnecting the top edge of a vertical longitudinal side 154 and a longitudinal edge of the top surface 150. The roof board further comprises a plurality of solid, rectangular bottom blocks 158 abutting the bottom surface of the main block 148. The bottom blocks 158 are regularly spaced so as to form a lateral recess 160 of uniform cross section between every two successive bottom blocks 158. A metal pipe 162 is to be tightly received within each recess for the purpose of improving the load bearing capacity of the roof board 20.

Still referring to FIGS. 1, 2, 22 and 23, the bottom blocks are dimensioned and attached to the bottom surface of the main block such that the lateral and longitudinal end portions of the bottom surface are exposed. The exposure of the longitudinal end portions of the bottom surface is of particular interest because the lower chords 24 of opposing joists 18 carry the roof board 20 about the longitudinal end portions as the joists 18 support the roof boards 20 as seen in FIGS. 1 and 2.

Figure 24:
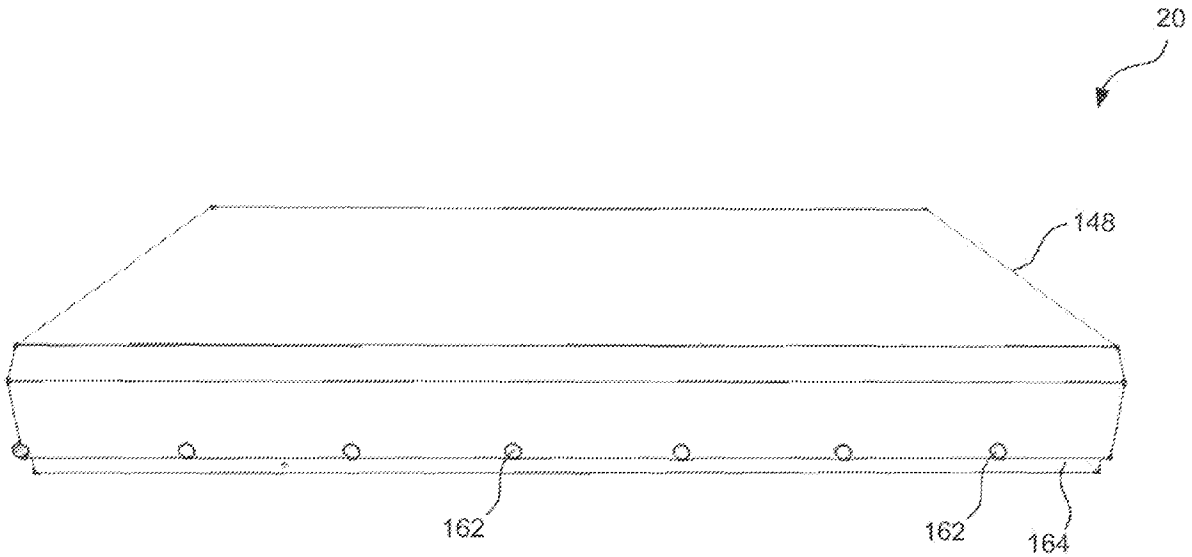
FIGS. 24 and 25 are different illustrations of the additional embodiment of the roof board according to the present invention.
Figure 25:
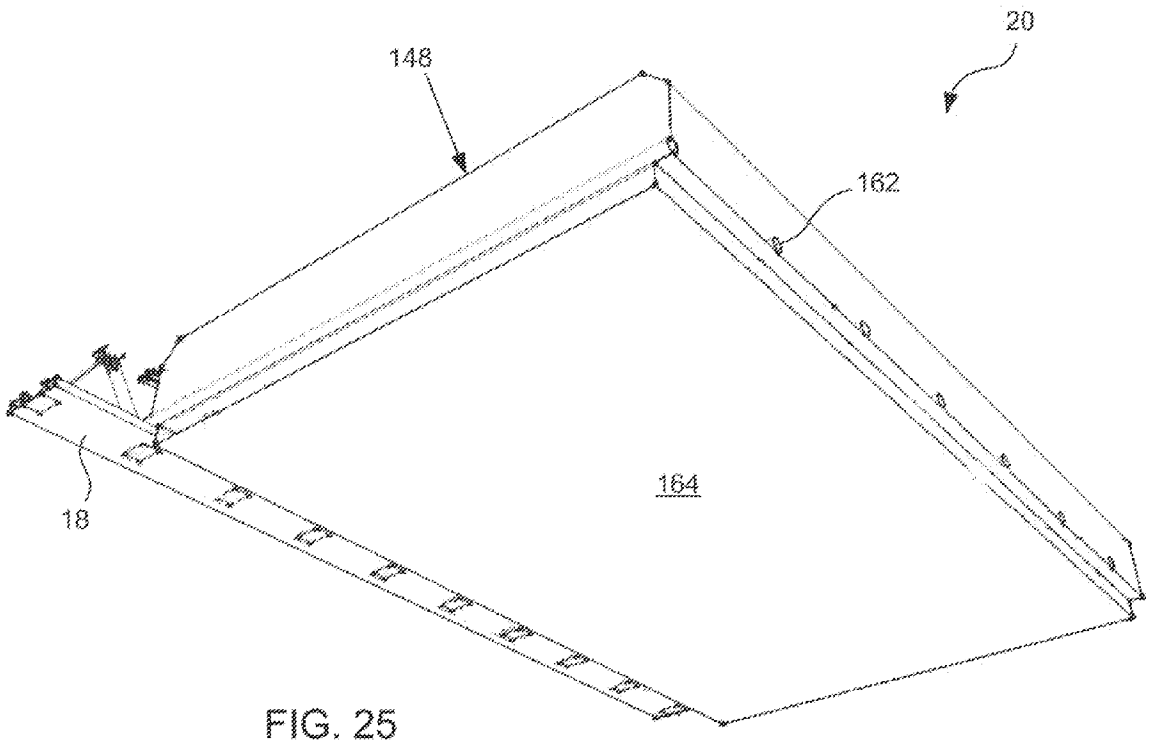

In another embodiment of the roof board 20 shown in FIGS. 24 and 25, the bottom surface of the main block 148 comprises the plurality of lateral recesses for receiving the metal pipes 162 while the plurality of bottom blocks 158 is replaced by a single bottom block 164. The stepped configuration is maintained as the single bottom block 164 abuts the bottom surface.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiment herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

What is claimed is:

1. A roof structure comprising:

(a) a plurality of cold-formed columns, each column comprising a pair of vertical posts attached to each other in juxtaposition, each post of a substantially tapered I-beam cross section comprising an elongate vertical column web interconnecting a pair of column flanges wherein the outer vertical surfaces of the column flanges are horizontal, the cross-section of each column symmetrical about central horizontal and vertical axes;

(b) a plurality of cold-formed girders supported by the plurality of columns, each girder of a substantially tapered I-beam cross section comprising an elongate girder web interconnecting a pair of upper and lower girder flanges wherein the top and bottom surfaces of the girder flanges are horizontal, the cross-section of each girder symmetrical about central horizontal and vertical axes;

(c) a plurality of cold-formed beams supported by the plurality of girders, each beam comprising a tapered I-beam comprising an elongate beam web interconnecting a pair of upper and lower beam flanges wherein the top and bottom surfaces of the beam flanges are horizontal the cross-section of each beam symmetrical about central horizontal and vertical axes;

(d) a plurality of open web joists supported by the plurality of beams, each joist comprising a cold-formed upper chord, a cold-formed lower chord, and a triangulated open web interconnecting the upper and lower chords wherein, the open web comprises a plurality of angled open web members, each open web member interconnecting the upper and lower chords by means of forging, the cross-section of each joist symmetrical about a central vertical axis; and (e) a plurality of roof boards supported by the plurality of joists.

2. The structure of claim 1 wherein, the opposite ends of each open web member is fixedly connected to the upper and lower chords.

3. The structure of claim 1 wherein, the opposite ends of each open web member is connected to the upper and lower chords as rule joints.

4. The structure of claim 1 wherein, each open web member is formed by bending a metal rod so as to form a pair of parallel sections, each comprising upper and lower ends, an upper-chord-connecting section interconnecting the upper ends of the parallel sections such that the upper-chord-connecting section is substantially perpendicular to the pair of parallel sections, and a pair of lower-chord-connecting sections extending perpendicularly and outwardly from the pair of parallel sections; the upper and lower chords interconnected by the open web member about upper and lower-chord-connecting sections respectively.

5. The structure of claim 4 wherein, the upper chord comprises an elongate, vertical upper-chord-connecting wall comprising a plurality of equidistant holes disposed thereon wherein, each hole receives the upper-chord-connecting section therewithin, and an elongate member attached to the top edge of the upper-chord-connecting wall; the elongate member comprising a substantially planar top surface.

6. The structure of claim 5 wherein, the elongate member comprises a hollow member of uniform rectangular cross section comprising an elongate top wall, an elongate bottom wall, and a pair of elongate opposing sidewalls connecting the longitudinal edges of the top and bottom walls, the pair of side walls disposed parallel to the upper-chord-connecting wall.

7. The structure of claim 4 wherein, the lower chord comprises:

(a) a pair of opposing, vertical, lower-chord-connecting walls each comprising a plurality of equidistant holes disposed thereon such that the holes on either lower-chord-connecting walls are aligned, each pair of opposing holes for receiving the pair of lower-chord-connecting sections therethrough, and (b) an elongate horizontal, rectangular lower panel longitudinally attached to the bottom edges of the pair of lower-chord-connecting walls; the lower panel extending laterally beyond the connecting point of the pair of lower-chord-connecting walls.

8. The structure of claim 7 wherein, the lower chord further comprises a pair of elongate metal strips of substantially L-shaped cross section, wherein the longitudinal edges of each strip connects the longitudinal top edge of a lower-chord-connecting wall and the longitudinal edge of the lower panel thereby forming a hollow metal tube of uniform rectangular cross section; the lower chord formed by longitudinal bending a metal sheet.

9. The structure of claim 4 wherein, the lower chord comprises a pair of opposing, elongate, horizontal, lower-chord-abutting rectangular metal strips wherein, each lower-chord-abutting strip fixedly rests over the plurality of lower-chord-connecting sections, an elongate, horizontal, rectangular lower panel disposed parallel to the pair of lower-chord-abutting strips, and a pair of opposing, elongate, vertical, rectangular side strips, each interconnecting the lower-chord-abutting strips and the lower panel; the lower chord formed by longitudinal bending a metal sheet.

10. The structure of claim 4 wherein, the upper chord comprises a plurality upper-chord segment members, each comprising a vertical upper-chord-connecting wall segment comprising a hole disposed thereon, each hole for receiving the upper-chord-connecting section therewithin, and a horizontal, rectangular upper panel segment attached to the top edge of each upper-chord-connecting wall segment, and an elongate, hollow bar attached on top of the plurality of upper-chord segment members; each upper-chord segment member cold-formed by longitudinally bending a metal sheet.

11. The structure of claim 4 wherein, the upper chord comprises a plurality upper-chord segment members wherein each segment member comprises a vertical upper-chord-connecting wall segment comprising a hole disposed thereon, each hole for receiving the upper-chord-connecting section therewithin, and a metal tube segment upwardly extending from the top edge of each wall, and an elongate hollow member received within the plurality of tube segments; the outer surface of the hollow member conforming to the inner surface of the plurality of tube segments; each upper-chord segment member and the upper-chord hollow member cold-formed by longitudinally bending a plurality metal sheets.

12. The structure of claim 4 wherein, the lower chord comprises a plurality of lower-chord segment members, each comprising a pair of opposing vertical lower-chord-connecting wall segments, each comprising a hole disposed thereon, the pair holes for receiving the pair of lower-chord-connecting sections therethrough, a horizontal rectangular bottom panel interconnecting the bottom edges of the vertical wall segments, and a pair of horizontal rectangular flanges, each extending outwardly from the top edge of a lower-chord-connecting wall segment, and an elongate platform comprising a longitudinal groove within which the plurality of lower-chord segment members are fixedly received such that the bottom surfaces of the plurality of rectangular bottom panels abut the surface of the groove.

13. The structure of claim 1 wherein, the girder is formed by:

(a) longitudinally bending each of a pair of metal sheets at right angles at first and second points so as to form a vertical girder web section and a pair of opposing upper and lower horizontal girder flange sections, the first and second points located at an equal distance from first and second longitudinal edges of the metal sheet respectively;

(b) longitudinally bending the pair of upper and lower girder flange sections at third and fourth points respectively, the upper and lower girder flanges bent inwardly towards the girder web section at an acute angle so as to form a pair of opposing elongate horizontal sides and a pair of opposing elongate angled panels, each extending from the longitudinal edge of the elongate horizontal side, the third and fourth points located at an equal distance from the first and second longitudinal edges respectively;

(c) longitudinally bending the pair of upper and lower angled panels at fifth and sixth points respectively, the pair of upper and lower angled panels bent outwardly away from the girder web section so as to form a pair of opposing elongate angled sides and a pair of opposing elongate vertical collars, each extending from the longitudinal edge of the angled side and fixedly abutting the girder web section, the fifth and sixth points located at a equal distance from the first and second longitudinal edges respectively; and (d) attaching the planar side of bent sheets on either planar sides of an elongate rectangular girder web so as to form a tapered substantially I-shaped beam; the girder web is of hollow rectangular cross-section.

14. The structure of claim 13 wherein, the girder further includes a pair of elongate, cold-formed, girder flange reinforcing members comprising an outer surface and an inner surface wherein, the inner surface of each reinforcing member fixedly abuts the outer surface of a girder flange, and the surface of each collar; the reinforcing members built by bending metal sheets.

15. The structure of claim 1 wherein, each cold-formed beam flange is built by longitudinally bending a metal sheet at an acute angle at first and second points so as to form an elongate horizontal side and a pair of elongate angled panels, the first and second points located at an equal distance from first and second longitudinal edges of the metal sheet respectively, and longitudinally bending the metal sheet outwardly at third and fourth points, each point located on an angled panel so as to form a pair of vertical strips and a pair of angled sides, the third and fourth points located at an equal distance from the first and second longitudinal edges respectively wherein, the inner surfaces of the pair of vertical strips of each beam flange fixedly abut the outer opposing surfaces of the beam web comprising a vertical, rectangular metal strip wherein, the top and bottom edges of the metal strip abut the inner surfaces of the top and bottom beam flanges respectively.

16. The structure of claim 15 wherein, the longitudinal edge of each vertical strip comprises a series of web-connecting edges, a series of non-web-connecting edges wherein, each non-web-connecting edge disposed between a pair of web-connecting edges, and a plurality of angled edges joining the successive web-connecting and non-connecting edges; the inner surfaces extending from each pair of opposing web-connecting edges of the pair of vertical strips of each girder flange fixedly abut the outer opposing surface of a vertical, rectangular beam web panel, the plurality of beam panels make up the girder web.

17. The structure of claim 1 wherein, each column flange is built by:

(a) longitudinally bending a metal sheet at an acute angle at first and second points so as to form an elongate rectangular main side and a pair of elongate rectangular angled panels extending from the elongate edges of the main side, the first and second points located at an equal distance from first and second elongate edges of the metal sheet respectively, and (b) longitudinally bending the metal sheet outwardly at third and fourth points, each point located on an angled panel so as to form a pair of angled sides and a pair of elongate strips, each disposed substantially perpendicular to the main side, the third and fourth points located at an equal distance from the first and second elongate edges respectively;

wherein, the inner surfaces of the pair of vertical strips of each column flange fixedly abut the outer opposing surfaces of the column web and wherein, the pair of vertical posts fixedly abut about the first points of column flanges so that the column webs of the pair of vertical posts are disposed in a parallel relationship; the column web of each post extending upward beyond the length of the column flanges; the column web comprising a vertical, rectangular metal strip wherein, the top and bottom edges of the metal strip abut the inner surfaces of the top and bottom column flanges respectively.

18. The structure of claim 1 wherein, each roof board comprises:

(a) a main solid block comprising a rectangular bottom surface, a rectangular planar top surface, a pair of vertical lateral sides, each interconnecting the lateral edges of the top and bottom surfaces, a pair of vertical longitudinal sides, each extending upwardly from a longitudinal edge of the bottom surface, and a pair of longitudinal slant sides, each interconnecting the top edge of a vertical longitudinal side and a longitudinal edge of the top surface;

(b) a plurality of solid, rectangular bottom blocks abutting the bottom surface of the main block, the bottom blocks are regularly spaced so as to form a plurality of lateral recesses of uniform cross section therebetween, the plurality of bottom blocks laterally lie within the bottom surface so as to expose end lateral portions of the bottom surface, the end lateral portions to rest on the lower chords of opposing, successive joists as the roof board is supported between the joists; and (c) a plurality of metal pipes, each to be tightly received within a recess, the metal pipes for improving the load bearing capacity of the roof board; the roof boards made of polystyrene.

19. The structure of claim 1 wherein, the metal sheets employed forming each of the columns, girders, beams, joists, or parts thereof comprise ST32 sheets.

20. The structure of claim 1 wherein, the metal sheets employed forming each of the columns, girders, beams, joists, or parts thereof comprise ST57 sheets.

* * * * *